US008437651B2

(12) United States Patent
Kamata

(10) Patent No.: US 8,437,651 B2
(45) Date of Patent: May 7, 2013

(54) IMAGE FORMING APPARATUS AND METHOD FOR DISPLAYING RESERVED JOBS ON A LIST

(75) Inventor: Yoshihisa Kamata, Hadano (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 303 days.

(21) Appl. No.: 12/874,251

(22) Filed: Sep. 2, 2010

(65) Prior Publication Data

US 2011/0052242 A1 Mar. 3, 2011

(30) Foreign Application Priority Data

Sep. 3, 2009 (JP) ..... 2009-204151

(51) Int. Cl.
*G03G 15/00* (2006.01)

(52) U.S. Cl.
USPC ..... 399/81; 399/82

(58) Field of Classification Search ..... 399/81, 399/82, 85, 87; 358/1.15, 1.13; 715/273
See application file for complete search history.

(56) References Cited

U.S. PATENT DOCUMENTS 5,669,040 A * 9/1997 Hisatake ..... 399/83
6,944,412 B2 * 9/2005 Mishima et al. ..... 399/81
7,120,910 B2 * 10/2006 Matsuda et al. ..... 718/102
7,706,013 B2 * 4/2010 Maeda ..... 358/1.16
8,115,949 B2 * 2/2012 Toda ..... 358/1.15
8,243,311 B2 * 8/2012 Yoshimura ..... 358/1.15
2011/0123214 A1 * 5/2011 Van Vliembergen et al. .. 399/82

FOREIGN PATENT DOCUMENTS

JP 2002-225389 A 8/2002

* cited by examiner

*Primary Examiner* — Robert Beatty
(74) *Attorney, Agent, or Firm* — Buchanan Ingersoll & Rooney PC

(57) ABSTRACT

Disclosed is an image forming apparatus, which makes it possible to visually recognize a suitable time when an operator should stay at the machine side, even if a reserved job includes a job continuous implementation impeding factor. The image forming apparatus includes: an image forming section to implement the reserved job; an operating section to accept operations for inputting a plurality of reserved jobs; a controlling section to extract a specific reserved job, which includes the job continuous implementation impeding factor, from the plurality of reserved jobs inputted through the operating section, so as to set discrimination information representing the job continuous implementation impeding factor into the specific reserved job; and a displaying section to display the specific reserved job to which the discrimination information is set and other reserved jobs to which the discrimination information is not set, on the same screen in a synopsis manner.

18 Claims, 15 Drawing Sheets

GS: IMAGE FORMING SYSTEM

FIG. 7

JG

91

COPY | SCANNING | STORAGE | READOUT | JOB LIST | MACHINE STATUS

YOU CAN SELECT ANY ONE OF JOBS ON LIST.
YOU CAN CONDUCT JOB OPERATION IN REGARD TO SELECTED JOB.

DOCUMENT OF PREVIOUS JOB --------
NUMBER OF RESERVED JOBS 0
RESIDUAL STORAGE CAPACITY 0.000%
RESIDUAL STORAGE CAPACITY OF HDD ---%

B7 JOB | OUTPUT HISTORY | TRANSMISSION HISTORY | OUTPUT-PENDING HISTORY | DEVELOPING STATUS

G2

| DURING OPERATION | MODE | STATE | NUMBER OF PAPER SHEETS | NUMBER OF COPIES | NUMBER OF RESIDUAL PAPER SHEETS | TIME (MINUTES) | USER'S NAME | FILE NAME |
|---|---|---|---|---|---|---|---|---|
| 0010 | PRINTER | MID-COURSE OF OUTPUTTING | 20 | 50 | 100 | 1 | ABCD | abcdefg |
| 0011 | COPYING | OUTPUTTING ENABLE | 20 | 50 | 1000 | 9 | BCDA | bcdefga |
| 0012 | COPYING | OUTPUTTING ENABLE | 20 | 50 | 1000 | 9 | CDAB | cdefgab |
| 0013 | WAITING(P) | OUTPUTTING ENABLE | 20 | 50 | 1000 | 13:47 | DABC | defgabc |
| 0014 | COPYING | OUTPUTTING ENABLE | 10 | 40 | 400 | 7 T | BACD | efgabcd |
| 0015 | PRINTER | OUTPUTTING ENABLE | 20 | 50 | 1000 | 9 | ABDC | fgabcde |
| 0016 | COPYING | OUTPUTTING ENABLE | 20 | 50 | 800 | 7 | ACBD | gabcdef |
| 0017 | COPYING | PAPER SHEET RESERVATION | 20 | 50 | 1000 | 9 | DBCA | gbcdefa |
| 0018 | PRINTER | MID-COURSE OF RECEIVING | 20 | 40 | 800 | 7 | ADCB | acdefgb |
| 0019 | PROOFING(P) | OUTPUTTING ENABLE | 20 | 50 | 1000 | 14:35 | CBAD | abcedfg |

0001/0001 △ ▽ SETTING CHANGE | DETAIL | PREFERENTIAL OUTPUT | PREFERENCE | SUSPENSION | DELETION

G3

| MID-COURSE OF SUSPENSION | MODE | STATE | NUMBER OF PAPER SHEETS | NUMBER OF COPIES | NUMBER OF RESIDUAL PAPER SHEETS | TIME (MINUTES) | USER'S NAME | FILE NAME |
|---|---|---|---|---|---|---|---|---|
| 0001 | PRINTER | MID-COURSE OF SUSPENSION | 1000 | 1000 | 1000 | ------ | (ABCD)' | (abcdefg)' |
| 0002 | COPYING | MID-COURSE OF SUSPENSION | 1000 | 1000 | 1000 | ------ | (BCDA)' | (bcdefga)' |
| 0003 | PRINTER | MID-COURSE OF SUSPENSION | 1000 | 1000 | 1000 | ------ | (CDAB)' | (cdefgab)' |
| 0004 | PRINTER | MID-COURSE OF SUSPENSION | 1000 | 1000 | 1000 | ------ | (DABC)' | (defgabc)' |
| 0005 | COPYING | MID-COURSE OF SUSPENSION | 1000 | 1000 | 1000 | ------ | (BACD)' | (efgabcd)' |

0001/0001 TICKET EDITION | △ ▽ SUSPENSION RELEASE | ALL RELEASE

IMAGE ROTATION | TONER SUPPLY

STATE OF JOB ABSENCE

STATE THAT COPY (SCANNING) OPERATION HAS BEEN COMMENCED

STATE THAT COPY (PRINTING) OPERATION HAS BEEN COMMENCED

IMAGE FORMING APPARATUS AND METHOD FOR DISPLAYING RESERVED JOBS ON A LIST

This application is based on Japanese Patent Application NO. 2009-204151 filed on Sep. 3, 2009, with the Japan Patent Office, the entire content of which is hereby incorporated by reference.

BACKGROUND OF THE INVENTION

The present invention relates to an image forming apparatus and an image forming method, each of which can be preferably applied to such an imaging apparatus, such as a copier, a printer, a digital MFP (Multi Function Peripheral), etc., that implements reserved jobs in each of which an image forming condition, such as a waiting mode, a proofing mode, etc., is attached to an image file concerned and each of which is registered in advance.

In recent years, various kinds of image forming apparatuses, including a digital MFP, etc., each of which is provided with a copy function, a printer function, a facsimile function and a communication function for communicating with external apparatuses, have been increasingly employed in the imaging field.

According to such the image forming apparatus as abovementioned, in such the case that a large number of print jobs are reserved so as to continuously conduct the print outputting operation of the print jobs reserved, when plural print jobs are separately accepted so as to conduct the print outputting operations of the accepted print jobs in the same printing section or when a new print job is accepted in mid-course of the image outputting operation, the reserved print jobs are store in a storage section to make them wait in the standby state, until the turn for implementing each print outputting operation, corresponding to an each individual print job, arrives. Then, at the time when the turn for implementing the print outputting operation of a print job, waiting in the standby state, arrives, the print outputting operation is commenced.

In regard to the image forming apparatus abovementioned, Tokkai 2002-225389 (Japanese Patent Application Laid-Open Publication) (Page 8, FIG. 11) sets forth an image forming apparatus that is provided with a copy function, a printer function, a facsimile function and a communication function for communicating with external apparatuses. According to the descriptions set forth in Tokkai 2002-225389, the image forming apparatus is provided with an inputting section, a storage section, a display device and an image forming/outputting section, so that the inputting section is operated so as to input a print job therefrom, the storage section stores the print job inputted from the inputting section therein, and the display device displays such a print job that is currently in the standby state for waiting its turn to be commenced, among the print jobs stored in the storage section, which are to be outputted by the image forming and outputting section, thereon.

The image forming/outputting section forms and outputs an image on the basis of the print job stored in the storage section. On the abovementioned premise, the display device displays the print jobs, each of which is currently in the standby state for waiting its turn, in separate displaying modes being different between an implementable job and a non-implementable job. For instance, the image forming apparatus is so constituted that the display device displays a list in which contents of the print jobs, each of which is currently in the standby state for waiting its turn, are displayed in various displaying modes being different corresponding to non-implementable levels of the print jobs concerned.

According to the configuration of the image forming apparatus as abovementioned, it becomes possible for the user to determine whether a print job currently in the standby state is implementable or non-implementable, by viewing the list at first glance. In addition, it also becomes possible for the user to easily determine whether the setting conditions of plural print jobs currently in the standby state are suitable for the apparatus status of the image forming apparatus concerned.

However, according to the image forming system provided with the conventional image forming apparatus as abovementioned, when a large number of print jobs are reserved, and then, the print outputting operations based on the print jobs are conducted continuously, there have arisen such the problems as follows.

(1) According to the image forming apparatus set forth in Tokkai 2002-225389, it is determined whether each of the print jobs currently in the standby state is implementable or non-implementable, so that the display device displays the print jobs, each of which is currently in the standby state for waiting its turn, in the separate displaying modes being different between the implementable job and the non-implementable job.

However, when the waiting mode, in which the image forming conditions are displayed and the operation for implementing the reserved job is suspended until the user (serving as an operator) conducts the outputting operation, is established, it has been impossible for the user to recognize the time when the user stays at the apparatus side.

(2) Further, when the proofing mode, in which the printing operations of the concerned apparatus are disabled after a printing operation for a single copy in regard to the reserved job is completed irrespective of the total number of copies to be printed, is established, it has been also impossible for the user to recognize the time when the user stays at the apparatus side. Concretely speaking, when such the print job that makes the continuous printing operations disable at the waiting mode or the proofing mode is included in the reserved jobs, the conventional image forming apparatus set forth in Tokkai 2002-225389 has not been provided with such the feature for displaying a recognizable message on this matter. Accordingly, after a considerable time has elapsed since the concerned apparatus was stopped and the implementation commencement time for the reserved job concerned has passed, at the time when the user watches the display panel, the user manages to recognize the fact that the current job includes the waiting/proofing mode, at last. Therefore, a job including waiting/proofing mode has been one of causes for deteriorating the efficiency and productivity of the image forming system as whole.

SUMMARY OF THE INVENTION

To overcome the abovementioned drawbacks in conventional image forming apparatus, it is one of objects of the present invention to provide an image forming apparatus and image forming method, each of which makes it possible for the operator (user) to visually recognize the suitable time when the operator should stay at the machine side concerned, even if the reserved job includes the job continuous implementation impeding factor, such as the waiting mode, the proofing mode, etc., and thither, each of which makes it possible to improve the efficiency of print producing operations to be conducted by handling a large number of print jobs.

Accordingly, at least one of the objects of the present invention can be attained by any one of the image forming apparatuses described as follows.

(1) According to an image forming apparatus reflecting an aspect of the present invention, the image forming apparatus, wherein a print job is defined as such a processing for forming an image onto a transfer sheet based on predetermined image information and image forming conditions, and wherein a job continuous implementation impeding factor is defined as such a factor that serves as a cause of impeding a continuous implementation of plural print jobs, each being the print job, when the plural print jobs are to be continuously implemented, and wherein a reserved job is defined as such a processing for setting and registering the image forming conditions including the job continuous implementation impeding factor into the predetermined image information, the image forming apparatus comprises: an image forming section to implement the reserved job; an operating section to accept operations for inputting a plurality of reserved jobs to be implemented by the image forming section; a controlling section to extract a specific reserved job, which includes the job continuous implementation impeding factor, from the plurality of reserved jobs inputted through the operating section, so as to set discrimination info ration representing the job continuous implementation impeding factor into the specific reserved job extracted from the plurality of reserved jobs; and a displaying section to display the specific reserved job to which the discrimination information is set and other reserved jobs to which the discrimination information is not set, both included in the plurality of reserved jobs, on a same screen in a synopsis manner.

(2) According to another aspect of the present invention, in the image forming apparatus recited in item 1, the displaying section displays the reserved job, which is currently in mid-course of implementing, or a plurality of reserved jobs, including the specific reserved job to which the discrimination information is set, and each of which is in a standby state for waiting its implementation turn, on a job schedule screen in which tray information is allotted in a direction of one of axes, while, time information is allotted in a direction of another one of the axes.

(3) According to still another aspect of the present invention, in the image forming apparatus recited in item 2, the displaying section displays the specific reserved job to which the discrimination information is set, in such a manner that the specific reserved job can be discriminated from the other reserved jobs to which the discrimination information is not set, on the job schedule screen in the synopsis manner.

(4) According to still another aspect of the present invention, in the image forming apparatus recited in item 1, the displaying section displays the reserved job, which is currently in mid-course of implementing, or a plurality of reserved jobs, each of which is in a standby state for waiting its implementation turn, on a job list screen in which the image forming conditions including the job continuous implementation impeding factor and the image information are written, corresponding to ID information for discriminating the reserved jobs with each other, in a synopsis manner.

(5) According to still another aspect of the present invention, in the image forming apparatus recited in item 4, the displaying section displays the specific reserved job to which the discrimination information is set and the other reserved jobs to which the discrimination information is not set, both included in the plurality of reserved jobs, on the job list screen in the synopsis manner by employing separate colors being different between the specific reserved job and the other reserved jobs.

(6) According to still another aspect of the present invention, in the image forming apparatus recited in item 5, with respect to the specific reserved job to which the discrimination information is set, the displaying section displays time information representing a time for commencing the print job on the job list screen.

(7) According to still another aspect of the present invention, in the image forming apparatus recited in item 6, when the specific reserved job, to which the discrimination information is set, is ranked at a leading top position on the job list screen, the displaying section displays the specific reserved job in a specific displaying mode being different from a displaying mode to be employed when the specific reserved job is not ranked at the leading top position.

(8) According to still another aspect of the present invention, in the image forming apparatus recited in item 1, a functional mode in which implementation of the reserved job is kept waiting, until the image forming conditions are displayed and an operator conducts outputting operations, is defined as a waiting mode; and wherein the job continuous implementation impeding factor includes the waiting mode.

(9) According to yet another aspect of the present invention, in the image forming apparatus recited in item 1, a functional mode in which, irrespective of a number of copies to be printed in respect to the reserved job, a printing machine is disabled after an operation for printing only a single copy has been completed, is defined as a proofing mode; and wherein the job continuous implementation impeding factor includes the proofing mode.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 7 shows an explanatory schematic diagram indicating a display example of a job list screen (fifth example);

DETAILED DESCRIPTION OF THE PREFERRED EMBODIMENT

Figure 1:
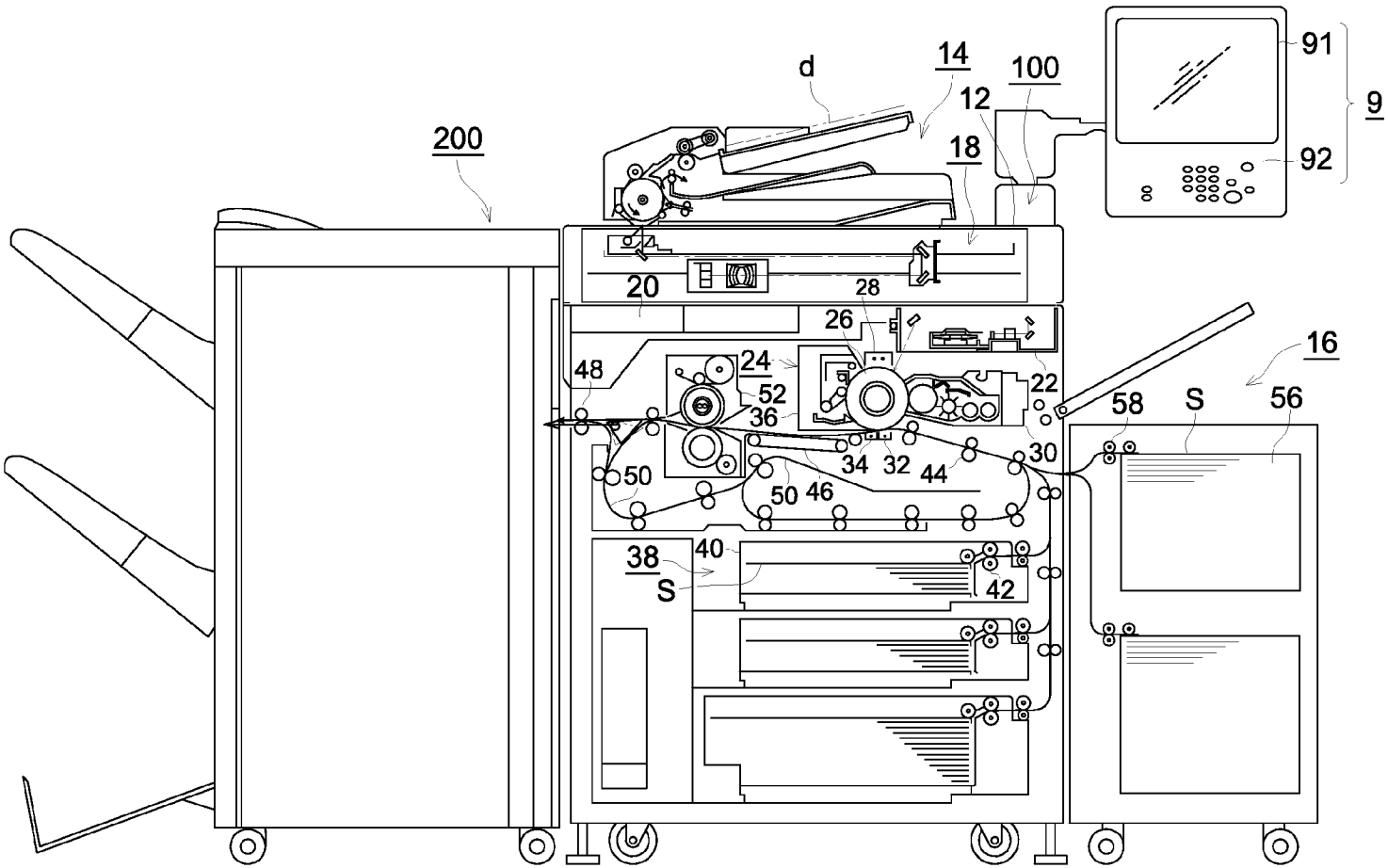
FIG. 1 shows a schematic diagram indicating an image forming system, which is provided with an image forming apparatus embodied in the present invention.

Referring to the drawings, the image forming apparatus and the image forming method, embodied in the present invention, will be detailed in the following.

FIG. 1 shows a schematic diagram indicating an image forming system GS, which is provided with an image forming apparatus embodied in the present invention. The image forming system GS is constituted by a mass-capacity paper sheet feeding apparatus 16, a digital MFP (Multi Function Peripheral) 100 and a post processing apparatus 200, so as to form an image onto a transfer sheet (hereinafter, referred to as a paper sheet S) based on predetermined image information (hereinafter, referred to as image data) and image forming conditions established in advance, and then, to apply a post processing to the paper sheet S on which the image is formed. In this example, the digital MFP 100 forms a predetermined image onto the paper sheet S, and then, conveys the paper sheet S with the image into the post processing apparatus 200.

As shown in FIG. 1, the digital MFP 100, representing an exemplified sample of image forming apparatuses embodied in the present invention, is provided with an apparatus main body 12 and an automatic document feeder 14. The automatic document feeder 14 is detachably mounted onto the top portion of the apparatus main body 12, so as to convey a document D, placed on the upper tray of the automatic document feeder 14, onto a document placing plate of the apparatus main body 12.

The apparatus main body 12 is constituted by a scanner section 18, a read processing section 20, a write processing section 22, a printer section 24, a paper-sheet feeding and conveying section 38 and a fixing device 52. For instance, the scanner section 18 is provided with an optical scanning and exposing device having a CCD (Charge Coupled Device) 81 (refer to FIG. 2), to irradiate light onto the document D conveyed onto the document placing plate, so that the CCD 81 read the light reflected from the document D so as to opt-electronically convert the intensity of the reflected light to an analogue image read signal. The read processing section 20 applies various kinds of image processing, including an analogue processing, an analogue to digital conversion processing and a shade processing, to the analogue image read signals, acquired through the opt-electronic converting process performed by the scanner section 18, so as to output digital image data representing the image of the document D.

The printer section 24, representing an exemplified structure of the image forming section, is constituted by, for instance, a photoreceptor drum 26, a charging section 28, a developing section 30, a transferring section 32, a separating section 34, and a cleaning section 36, so as to implement a reserved job for forming an image onto the paper sheet S based on the image data outputted from the scanner section 18 and the image forming conditions established in advance. Hereinafter, the reserved job is defined as such a job that is registered through a process for setting the image forming conditions (hereinafter, also referred to as job setting information), including a job continuous implementation impeding factor, into the image data concerned. Further, hereinafter, the job continuous implementation impeding factor is defined as such an impeding factor that impedes an operation for continuously implementing plural print jobs when the plural print jobs are to be implemented continuously. Still further, hereinafter, the print job is defined as such a process that is to be performed for forming an image onto the paper sheet S based on the image data and the job setting information established in advance.

A waiting mode serves as the job continuous implementation impeding factor above-defined. Hereinafter, the waiting mode is defined as such a function for making the implementation of the reserved job wait in the standby state until the job setting information is displayed and the operator (user) conducts the outputting operation. The waiting mode is established in such a case that, when a large number of print jobs are reserved to continuously implement the print jobs concerned, the print job associated with the standby operation of the printer section 24 is to be implemented.

Further, a proofing mode also serves as the job continuous implementation impeding factor above-defined. Hereinafter, the proofing mode is defined as such a function for stopping the machine after printing a single copy irrespective of a number of copies established in regard to the reserved job. The proofing mode is established in such a case that, when a large number of print jobs are reserved to continuously implement the print jobs concerned, the print job associated with the test printing operation is to be implemented.

The abovementioned members except the photoreceptor drum member, including the charging section 28, the developing section 30, the transferring section 32, the separating section 34, the cleaning section 36, etc., are disposed at respective positions located around the peripheral space of the photoreceptor drum 26. The charging section 28 uniformly charges the circumferential surface of the photoreceptor drum 26 before the image writing operation is performed. The write processing section 22 irradiates a modulated laser beam emitted from a semiconductor laser onto the photoreceptor drum 26, the circumferential surface of which is uniformly charged, so as to form a latent image on the circumferential surface of the photoreceptor drum 26. The developing section 30 develops the latent image formed on the photoreceptor drum 26 with toner, so as to form a toner image on the circumferential surface of the photoreceptor drum 26.

Successively, the transferring section 32 transfers the toner image onto the paper sheet S conveyed from, for instance, a paper sheet tray of the paper-sheet feeding and conveying section 38. Still successively, the paper sheet S, onto which the toner image is transferred, is separated from the circumferential surface of the photoreceptor drum 26 by the separating section 34, and conveyed to the fixing device 52. Further, the residual toner, remaining on the photoreceptor drum 26, are removed by the cleaning section 36.

The paper-sheet feeding and conveying section 38 is constituted by a plurality of paper sheet trays 40 provided with a pair of feeding rollers 42 (and a pick up roller), a pair of conveyance rollers 44, a transferring and conveying roller 46, a paper sheet ejecting section 48 and a paper sheet re-feeding section 50. The paper sheet S fed from one of the paper sheet trays 40 is conveyed to the transferring section 32 through the pair of feeding rollers 42 and the pair of conveyance rollers 44 so as to transfer the aforementioned toner image onto an obverse side surface of the paper sheet S at the transferring section 32. The paper sheet S onto which the toner image is transferred is further conveyed to the fixing device 52 by the transferring and conveying roller 46. In the fixing device 52, a pair of fixing rollers applies heat and pressure onto the paper sheet S with the toner image, so as to fix the transferred toner image onto the obverse side surface of the paper sheet S.

In the case of a single side printing mode, the paper sheet S to which the fix processing has been applied is further conveyed to either the post processing apparatus 200 or the paper sheet ejecting section 48, as it is. On the other hand, in the case of a duplex printing mode, the switchback action of the paper sheet re-feeding section 50 introduces the paper sheet S, to the obverse side of which the fix processing has been applied, into the paper sheet re-feeding path so as to transfer a predetermined image onto the reverse side of the paper sheet S in the printer section 24. Successively, the toner images transferred onto the reverse side of the paper sheet S are fixed onto the paper sheet S. Then, the paper sheet S having the fixed toner images on its both sides is conveyed to the post processing apparatus 200, etc.

The mass-capacity paper sheet feeding apparatus 16 is provided with a plurality of paper sheet stacking sections 56 and a pair of conveyance rollers 58. Paper sheets S corresponding to each of various kinds of paper sizes, such as an 8×11 size, an A4 size, an B5 size, etc., are stacked on each of the paper sheet stacking sections 56. The paper sheets S stacked on each of the paper sheet stacking sections 56 are sequentially picked up and continuously conveyed one by one at a predetermined timing to the printer section 24 of the apparatus main body 12 by the pair of conveyance rollers 58.

Figure 2:
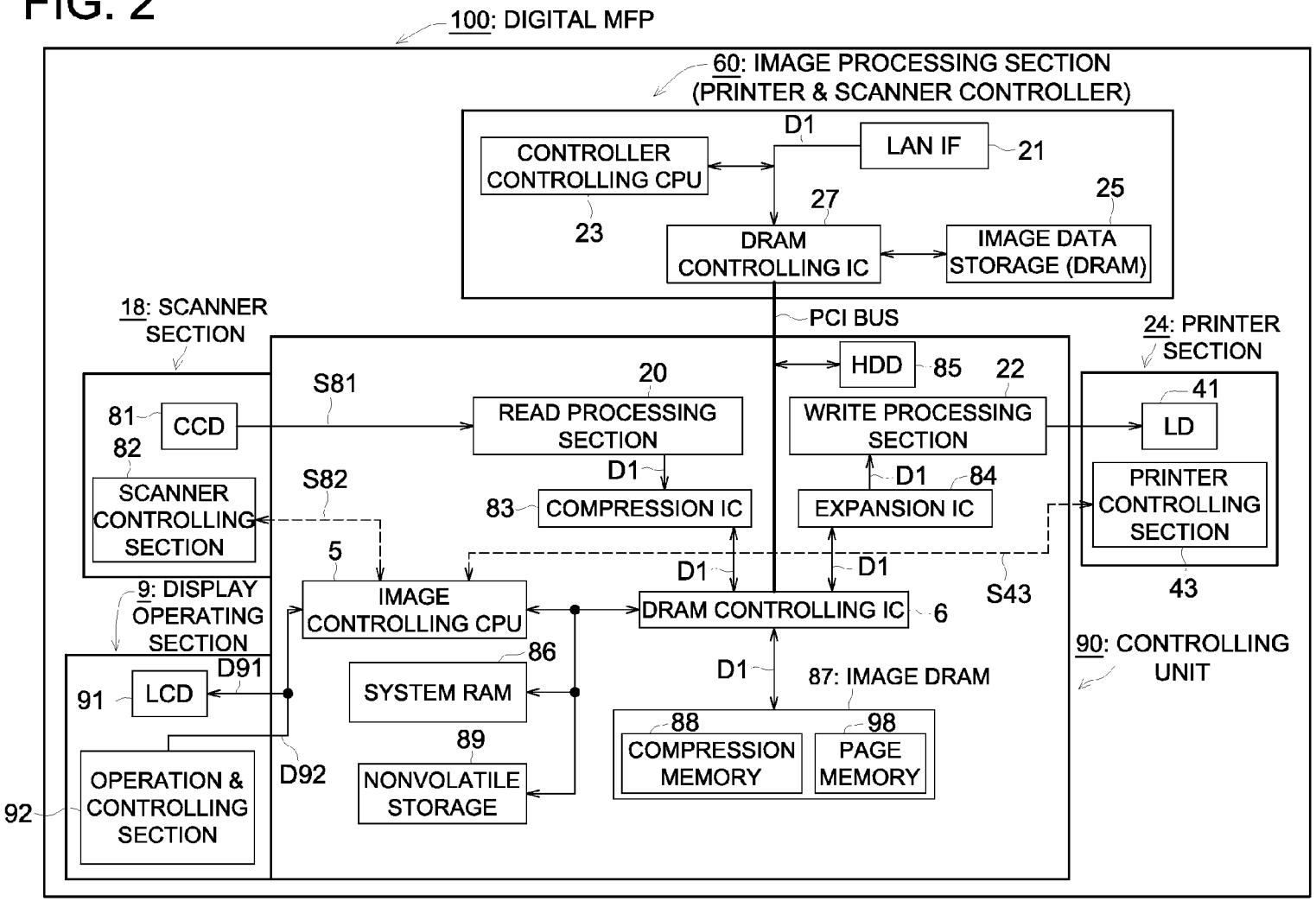
FIG. 2 shows a block diagram indicating an exemplified configuration of a control system of a digital MFP (Multi Function Peripheral) embodied in the present invention.

Next, referring to FIG. 2, an exemplified configuration of the control system of the digital MFP 100 will be detailed in the following. As shown in FIG. 2, the digital MFP 100 is constituted by a display operating section 9, the scanner section 18, an image processing section 60, the printer section 24 and a controlling unit 90.

The controlling unit 90 is constituted by an image controlling CPU (Central Processing Unit) 5, a DRAM (Dynamic Random Access Memory) controlling IC (Integrated Circuit) 6, the read processing section 20, the write processing section 22, a compression IC (Integrated Circuit) 83, an expansion IC (Integrated Circuit) 84, an HDD (Hard Disc Drive) 85, a system RAM (Random Access Memory) 86, an image DRAM (Dynamic Random Access Memory) 87 and a nonvolatile storage 89. Further, the image DRAM 87 is provided with a compression memory 88 and a page memory 98.

The HDD 85 stores image data D1 acquired by applying an image processing in the image processing section 60, therein. Other than the image data D1, sometimes, the HDD 85 may also stores a system program for booting the image forming system GS concerned and various kinds of programs (application programs) for controlling the image controlling CPU 5, the display operating section 9, the scanner section 18, the image processing section 60, the printer section 24, the post processing apparatus 200, etc. (not shown in the drawings), therein. The image controlling CPU 5 configures an example of the controlling section. The system program read out from the HDD 85 is developed onto the system RAM 86 when the image forming system GS is initially booted. Random Access Memories are employed in the system RAM 86.

The nonvolatile storage 89 stores, for instance, user data, such as an IP (Internet Protocol) address, etc., therein. The user data is established at the time of the initializing operation. EEPROMs (Electrically Erasable and Programmable Read Only Memory) or the like, in which stored data do not disappear even if a power supply is turned OFF, are employed in the nonvolatile storage 89. Other than the system RAM 86 and the nonvolatile storage 89, the display operating section 9 is also coupled to the image controlling CPU 5.

The display operating section 9 serves as both an operating section and a displaying section, and is constituted by a LCD (Liquid Crystal Display) monitor 91 and an operation & controlling section 92. The display operating section 9 is operated so as to accept a plurality of reserved jobs to be implemented by the printer section 24. On that occasion, the reception of the reserved job is achieved, for instance, by outputting operation data D92 for designating the reserved job concerned from the display operating section 9 to the image controlling CPU 5. Other than the inputting operation, the display operating section 9 is also operated so as to display the reserved jobs, for which the image controlling CPU 5 has established identification information of them, and the other reserved jobs, for which no identification information is established, on the same screen as a list.

Further, other than the processing for accepting the reserved jobs, the display operating section 9 is also operated at the time when job setting information Ds, etc., is to be established. The job setting information Ds includes various kinds of information, such as a one-side/duplex printing mode, a name of tray to be used, an outputting mode, residual time information, a status, a number of paper sheets, a number of copies, a number of residual paper sheets, a user's name, a file name, etc. The LCD monitor 91 employs a Liquid Crystal Display and provided with a touch panel mounted thereon.

The operation & controlling section 92 is provided with an inputting function to be conducted by the touch panel other than the various kinds of inputting tools, such as a ten key, etc., and coupled to the image controlling CPU 5. The operation & controlling section 92 conducts such controlling operations, so that the operation data D92 is transferred to the image controlling CPU 5 through the serial communication line, or display data D91 inputted from the image controlling CPU 5 is outputted to the LCD monitor 91. The display data D91 is used for displaying a job management screen JG on the LCD monitor 91, and for displaying a job schedule screen G1 and a job list screen G2 within the job management screen JG (refer to FIG. 3 through FIG. 9), and, for instance, is edited in the system RAM 86.

Further, an output time (time information=estimated value) of each of the reserved jobs is displayed on the job schedule screen G1 and the job list screen G2. Since the output times corresponding to the reserved jobs are displayed on the job schedule screen G1 and the job list screen G2, it becomes possible for the operator (user) to visually recognize the suitable time when the operator should stay at the machine side concerned.

According to the present embodiment, the image controlling CPU 5 reads out the display data D91 from the system RAM 86 to transfer the display data D91 to the LCD monitor 91 of the display operating section 9. Then, the LCD monitor 91 displays the job schedule screen G1, the job list screen G2, etc., based on the display data D91 read out from the system RAM 86.

Further, according to the present embodiment, the image controlling CPU 5 extracts such reserved jobs that include the job continuous implementation impeding factors, such as the waiting mode, the proofing mode, etc., from the reserved jobs accepted by the display operating section 9, so as to establish and attach an identification information, representing the job continuous implementation impeding factor, to each of the extracted reserved jobs. For instance, the identification information is an identification mark shaped in an inverted triangle (symbol "▼" indicated in FIG. 3), which is synthesized with the display data D91 based on which the job schedule screen G1 is displayed. Accordingly, it becomes possible for the operator to recognize the timing at which the concerned machine will be stopped due to the waiting mode, the proofing mode, etc., in advance.

The scanner section 18 is coupled to the controlling unit 90 abovementioned. The scanner section 18 is constituted by an image sensor (represented by the CCD 81 in the drawing) and a scanner controlling section 82, other than the automatic document feeder 14 shown in FIG. 1 (not shown in FIG. 2). The CCD 81 is coupled to the read processing section 20 of the controlling unit 90. While, the scanner controlling section 82 is coupled to the image controlling CPU 5 so as to control the scanner section 18 based on a scan controlling signal S82. Based on the controlling signal S82, the scanner section 18 reads the document D at the time of the copy mode so as to output an analogue image read signal S81. The scan controlling signal S82 is inputted to the scanner controlling section 82 from the image controlling CPU 5 through the serial communication line. The scan controlling signal S82 is used for controlling the scanner section 18 to perform the scanning exposure operation.

The analogue image read signal S81 outputted by the CCD 81 is inputted into the read processing section 20. The read processing section 20 applies various kinds of image processing, including an analogue processing, an analogue to digital conversion processing and a shading correction processing to the analogue image read signal S81, so as to generate and output the image data D1.

The compression IC 83 is coupled to the read processing section 20. The compression IC 83 applies a data compression processing to the image data D1 at the time of storing data. The DRAM controlling IC 6 is coupled to the compression IC 83. Other than the DRAM controlling IC 6, the image controlling CPU 5, the expansion IC 84, the system RAM 86, the image DRAM 87 and the nonvolatile storage 89 are also coupled to the DRAM controlling IC 6.

The DRAM controlling IC 6 stores the compression-processed image data D1 into the compression memory 88. The image DRAM 87 is provided with the page memory 98 other than the compression memory 88. Dynamic Random Access Memories are employed in the image DRAM 87. At the time of implementing the image forming (image writing) operation, the DRAM controlling IC 6 reads out the compressed image data D1 from the compression memory 88 and outputs the compressed image data D1 to the expansion IC 84. The expansion IC 84 applies a data expansion processing to the compressed image data D1 and outputs the expansion-processed image data D1 to the write processing section 22. In order to form a latent image onto the circumferential surface of the photoreceptor drum 26, the write processing section 22 drives a laser diode 41 of the printer section 24, based on the expansion-processed image data D1.

The printer section 24 is constituted by the laser diode 41 and a printer controlling section 43, in addition to the photoreceptor drum 26, the charging section 28, the developing section 30, the transferring section 32, the separating section 34 and 36 (not shown in FIG. 2), which have been described by referring to the configuration shown in FIG. 1. The laser diode 41 is coupled to the write processing section 22, so as to emit the laser beam, intensity of which is modulated on the basis of the image data D1.

The printer controlling section 43 is coupled to the image controlling CPU 5 so as to receive a printer controlling signal S43 transmitted from the image controlling CPU 5 through the serial communication line, to control the laser diode 41 and the printer section 24. In the printer section 24, the laser beam emitted from the laser diode 41 is irradiated onto the photoreceptor drum 26 so as to form a latent image on its circumferential surface. Further, in the printer section 24, based on the printer controlling signal S43, the consecutive image forming operations, including the paper sheet conveying operation, the charging, exposing, developing, transferring, separating, cleaning operations in regard to the photoreceptor drum 26, etc., are conducted so as to form a single image or plural images onto predetermined surface/surfaces of the paper sheet S, and then, the paper sheet ejecting operation, etc., are further conducted. According to the abovementioned, it becomes possible to implement the print job for forming image(s) onto the paper sheet S, based on the image data D1 and the job setting information Ds.

In this connection, for instance, although the image controlling CPU 5 calculates the residual time information by employing the equation of ("number of residual paper sheets"÷"size PPM"), the image controlling CPU 5 also takes into account the time between copies designated by the printer controlling section 43, after commencing the printing operation. Taking into account the factors abovementioned, the image controlling CPU 5 calculates the residual time information by employing the equation of ("number of residual paper sheets"÷"size PPM")+{("number of residual copies"−1)×(time between copies)}. The size PPM is defined as a printing time per one page of paper sheets. With respect to the job ranked at the leading top position (hereinafter, referred to as the leading top job), its display is updated to latest values, every time when the number of residual paper sheets and the residual time have been changed.

Further, other than the DRAM controlling IC 6, the image processing section 60 is also coupled to the HDD 85. The image processing section 60 is constituted by a LAN (Local Area Network) interface 21 to be used for the Local Area Network, a controller controlling CPU (Central Processing Unit) 23, a image data storage 25 (DRAM) and a DRAM (Dynamic Random Access Memory) controlling IC (Integrated Circuit) 27.

In the printer mode, the image data D1 is received from an external personal computer (external terminal device) through the LAN interface 21. The DRAM controlling IC 27 is coupled to the LAN interface 21. Further, other than the LAN interface 21, a PCI (Peripheral Component Interconnect) bus, the controller controlling CPU 23 and the image data storage 25 are also coupled to the DRAM controlling IC 27.

In the present embodiment, when the printer mode is established, the image processing section 60 receives the image data D1 from the external terminal device through LAN interface 21. The DRAM controlling IC 27 temporarily stores the image data D1, currently received, into the image data storage 25. After that, the DRAM controlling IC 27 transfers the image data D1 in a unit of a page to the controlling unit 90 through the PCI bus.

The controlling unit 90 stores the image data D1, transferred from the image processing section 60, into the page memory 98 through the DRAM controlling IC 6. After that, the DRAM controlling IC 6 outputs the image data D1 read from the page memory 98 to the compression IC 83. The compression IC 83 applies the compression processing to the image data D1 at the time of storing the data concerned. Successively, the DRAM controlling IC 6 stores the compression processed image data D1 into the compression memory 88 of the image DRAM 87.

At the time of the printer mode (image writing), the DRAM controlling IC 6 reads out the compressed image data D1 from the compression memory 88 so as to output the compressed image data D1 to the expansion IC 84. Then, the expansion IC 84 applies the expansion processing to the compressed image data D1 so as to output the expansion processed image data D1 to the write processing section 22. Successively, based on the expanded image data D1, the write processing section 22 drives the laser diode 41 of the printer section 24 in order to form the latent image onto the circumferential surface of the photoreceptor drum 26 shown in FIG. 1.

Next, referring to the schematic diagrams shown in FIG. 3 through FIG. 6, the job schedule screen G1 will be detailed in the following. According to the screen display example (first example) of the job schedule screen G1, by depressing (or touching) the icon button of "job management" displayed in a menu screen (not shown in the drawings), the job management screen JG is displayed on the LCD monitor 91 of the display operating section 9 shown in FIG. 1 and FIG. 2. In the area located at an upper side of job schedule screen G1 displayed within the job management screen JG, various kinds of icon buttons, including "COPY", "SCANNING", "STORING", "READING", "JOB LIST" and "MACHINE STATUS", are displayed. In this example, since an icon button B1 of "JOB LIST" is selected, the color of the icon button B1 has been turned to an aqua color from a gray color, while the display colors of the other icon buttons are still gray (no change).

In the area located at a lower side of the icon display area of the job management screen JG, the character information representing messages of "OPERATING ZOOM BUTTON, YOU CAN CHANGE DISPLAY SCALE" and "TOUCHING BAR, YOU CAN DISPLAY JOB INFORMATION" are displayed. Further, various kinds of icons, including "JOB", "SCHEDULING", "OUTPUT HISTORY", "TRANSMISSION HISTORY", "OUTPUT-PENDING HISTORY", "DEVELOPING STATUS", etc., are displayed below the character information abovementioned. In the area located at a lower side of the display area for displaying the abovementioned icons, tray information is allotted along a direction of an axis (vertical axis) of the job schedule screen G1, while required times (minutes) are allotted along a direction of another axis (horizontal axis) of the job schedule screen G1.

Various kinds of factors, for instance, "TRAY 1: INDETERMINATE FORM, PLAIN PAPER 106-135 g/m$^2$", "TRAY 2: B4□, PLAIN PAPER 64-74 g/m$^2$", "TRAY 2: B4□ (HORIZONTAL), PLAIN PAPER 64-74 g/m$^2$", "TRAY 3: A4□ (VERTICAL), PLAIN PAPER 64-74 g/m$^2$", "TRAY 4: 8.5×11□ (HORIZONTAL), PLAIN PAPER 64-74 g/m$^2$", "TRAY 5: 8.5×11□ (VERTICAL), PLAIN PAPER 64-74 g/m$^2$", "TRAY 6: A4□ (VERTICAL), PLAIN PAPER 64-74 g/m$^2$", "TRAY 7: 11×17□ (HORIZONTAL), PLAIN PAPER 64-74 g/m$^2$", "TRAY 8: A3□ (HORIZONTAL) (VERTICAL), PLAIN PAPER 64-74 g/m$^2$", etc., are displayed as the tray information.

In the drawings, "PI, 8.5×11□, PLAIN PAPER 64-74 g/m$^2$" and "PI, 11×17, PFU3, PLAIN PAPER 64-74 g/m$^2$", are the tray information of the post processing apparatus 200. Based on the abovementioned tray information, it becomes possible for the user to recognize not only the reserved job that uses a plurality of trays, but also the tray information with respect to the jobs including such a job that is in mid-course of print outputting operation. In this connection, the message of "NO CORRESPONDING PAPER SHEET" indicates a setting item representing a fact that no paper sheet tray is pertinent.

Numeral 0, 10, 20, 30, etc., are displayed as the required times (minutes). As the required times (minutes), the elapsed time from the time when the implementation of the initial reserved job was commenced is displayed along the time scale, for instance, divided in a unit of 10 minutes, as the required times (minutes). The variable setting function is employed for the displayed time scale, so that its time unit can be freely changed to any one of 10, 20, 30, 60, etc., (minutes) by operating an icon button B3 of "ZOOMING (ENLARGEMENT/REDUCTION)". The changeover range is set at 23 stages from minimum 30 minutes to maximum 24 hours.

In this example, the time information of the job schedule screen G1 is stored into the nonvolatile storage 89 for every changeover of the unit. For instance, at the time of turning ON the power source, at the time of shifting between modes, or at the time of shifting a screen from another screen, the time information stored in the nonvolatile storage 89 is read out, so as to display the required times (minutes) of the job schedule screen G1, based on the above-readout time information.

A reserved job, which is currently implemented by the printer section 24, or a plurality of reserved jobs, which are currently in the standby state for waiting its turn and includes a reserved job to which identification information is established, is/are displayed on the job schedule screen G1. In this example, the five reserved jobs respectively corresponding to job IDs="0001"-"0005" are displayed, and a job bar Jb is also displayed for every reserved job corresponding to each of the job IDs="0001"-"0005". The compartment location between a reserved job and another reserved job is indicated by alternately changing the contrasting density of the background color.

The job bars Jb is represented as a horizontal bar whose length is variable, so as to indicate the job status including the status of the reserved job and the residual time (to be indicated in a unit of second). In order to indicate the residual number of paper sheets S, the color of job bars Jb is divided into three colors corresponding to three levels of the residual numbers, so as to make the user recognize the current level of the residual numbers of paper sheets S. In this example, the horizontal bar concerned is indicated in any one or a combination of three colors, including a color of blue (action color; indicated by an area filed with hatched lines in FIGS. 3-6), a color of yellow (operating color; indicated by an area filed with a solid white in FIGS. 3-6) and a color of red (machine stoppage color; indicated by an area filed with a solid black in FIGS. 3-6).

For instance, the blue horizontal bar indicates such a status that a sufficient amount of paper sheets S is accommodated in the paper sheet tray and it is possible to implement a printing operation. The yellow horizontal bar indicates such a status that an amount of paper sheets S is gradually becoming short and the paper sheet tray will be vacant soon, and the shortage of the paper sheets S will occur in mid-course of the printing operation. The red horizontal bar indicates such a status that none of the paper sheets S are accommodated in the paper sheet tray at all, or the print outputting operation will be stopped in mid-course of the printing operation due to the shortage of the paper sheets S. As abovementioned, by indicating the job bars Jb while changing its color, it becomes possible not only to display the using tray for every job, but also to indicate the timings when the machine would be stopped for the paper sheet supplying operation step by step in different colors, so that the user can recognize the necessity of the paper sheet supplying operation beforehand.

The length of the horizontal bar to be displayed, serving as the job bar Jb, is calculated on the basis of the implementation time derived from the residual time displayed in the job list. Accordingly, it becomes possible for the user to grasp the residual time of the job from the length of the horizontal bar serving as the job bar Jb. For instance, according to the time scale in a unit of 10 minutes, when the length of the horizontal bar, serving as the job bar Jb, corresponds to a half of one unit length of the time scale, the user can confirm that the residual time of the job concerned is five minutes.

Further, the LCD monitor 91 displays the reserved job corresponding to the job ID="0003" to which a red identification mark M indicated by symbol "▼" is established and attached, in such a manner that the user can distinguishably recognize it with respect to the other reserved jobs respectively corresponding to job IDs="0001", "0002", "0004" and "0005" to be displayed on the job schedule screen G1 in the synopsis manner. The reserved job, attached with the red identification mark M and corresponding to the job ID="0003", is displayed in order to make the user recognize that the concerned reserved job includes the waiting mode and/or the proofing mode or the like in which the machine is to be stopped. By displaying the reserved job, attached with the red identification mark M and corresponding to the job ID="0003", as abovementioned, it becomes possible for the user to easily recognize the concerned print job, corresponding to the job ID="0003" and including the waiting mode or the like, among the five reserved jobs respectively corresponding to job IDs="0001"-"0005", when the user reserves a large number of print jobs and continuously implements the print outputting operations of them.

Figure 3:
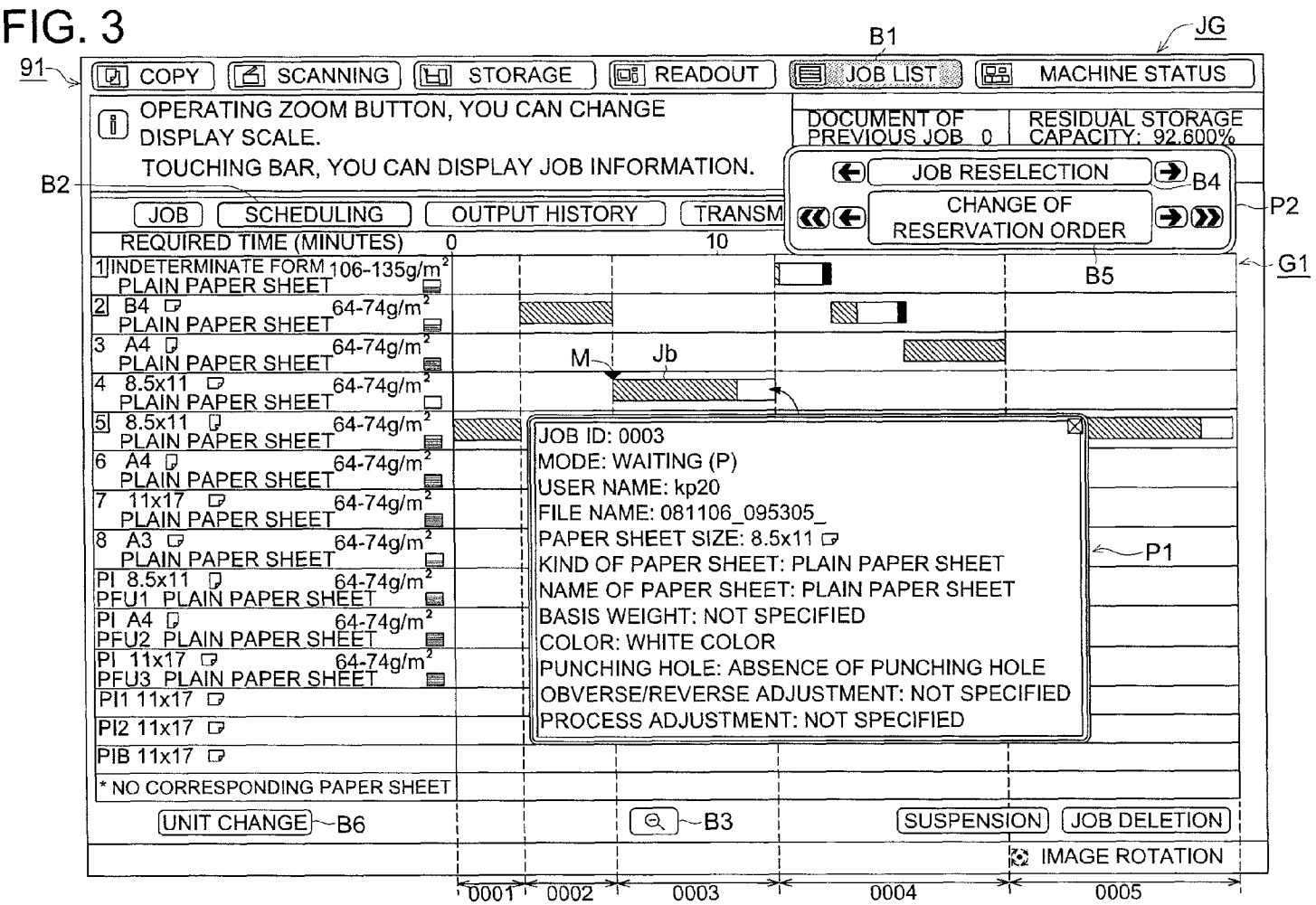
FIG. 3 shows an explanatory schematic diagram indicating a display example of a job schedule screen (first example)

In this example, by touching the job bar Jb, further detailed information will be displayed. For instance, by touching the job bar Jb of the reserved job, attached with the red identification mark M and corresponding to the job ID="0003", a popup screen P1 shown in FIG. 3 is displayed on the job schedule screen G1. In the popup screen P1, various kinds of setting items, including "JOB ID: 0003", "MODE: WAITING MODE (P)", "USER NAME: kp20", "FILE NAME: 081106 095305", "PAPER SHEET SIZE: 8.5×11□ (HORIZONTAL)", "PAPER KIND: PLANE PAPER", "NAME OF PAPER SHEET: PLANE PAPER", "BASIS WEIGHT: NOT SPECIFIED", "COLOR: WHITE", "PUNCH HOLE: ABSENCE OF PUNCH HOLE", "OBVERSE/REVERSE ADJUSTMENT: NOT SPECIFIED" AND "PROCESS ADJUSTMENT: NOT SPECIFIED", are displayed. As abovementioned, it becomes possible to display the setting contents of the reserved job concerned, such as the waiting mode, the proofing mode, etc., in the enlarged screen area superimposed on the job schedule screen G1 as the popup screen.

Further, a popup screen P2 is also displayed at a right upper position of the job schedule screen G1 at the same time when the popup screen P1 is displayed. In the popup screen P2, icon buttons B4 and B5 of "JOB RESELECTION" and "CHANGE OF RESERVATION ORDER" are displayed. The icon buttons B4 and B5 are to be depressed when the user intends to reselect the reserved job or to change the reservation order of the reserved jobs. For instance, when the right or left arrow of the icon buttons B4 of "JOB RESELECTION" is depressed in the job selecting status, either the previous job or the next job is selected and the selected tray information is displayed on the popup screen P1.

Further, the icon buttons B5 of "CHANGE OF RESERVATION ORDER" (four kinds) are operated to be depressed in the job selecting status. For instance, by depressing the left arrow button, the priority order of the selected reserved job is shifted to an upper rank by one. By depressing the left double arrow button, the priority order of the selected reserved job is jumped to a top rank in the reservation order. The abovementioned functions are the same as those to be operated by using the icon of "PREFERENCE". Further, by depressing the right arrow button, the priority order of the selected reserved job is shifted to a lower rank by one. By depressing the right double arrow button, the priority order of the selected reserved job is jumped to a bottom rank in the reservation order of the fixed reserved jobs.

Figure 4:
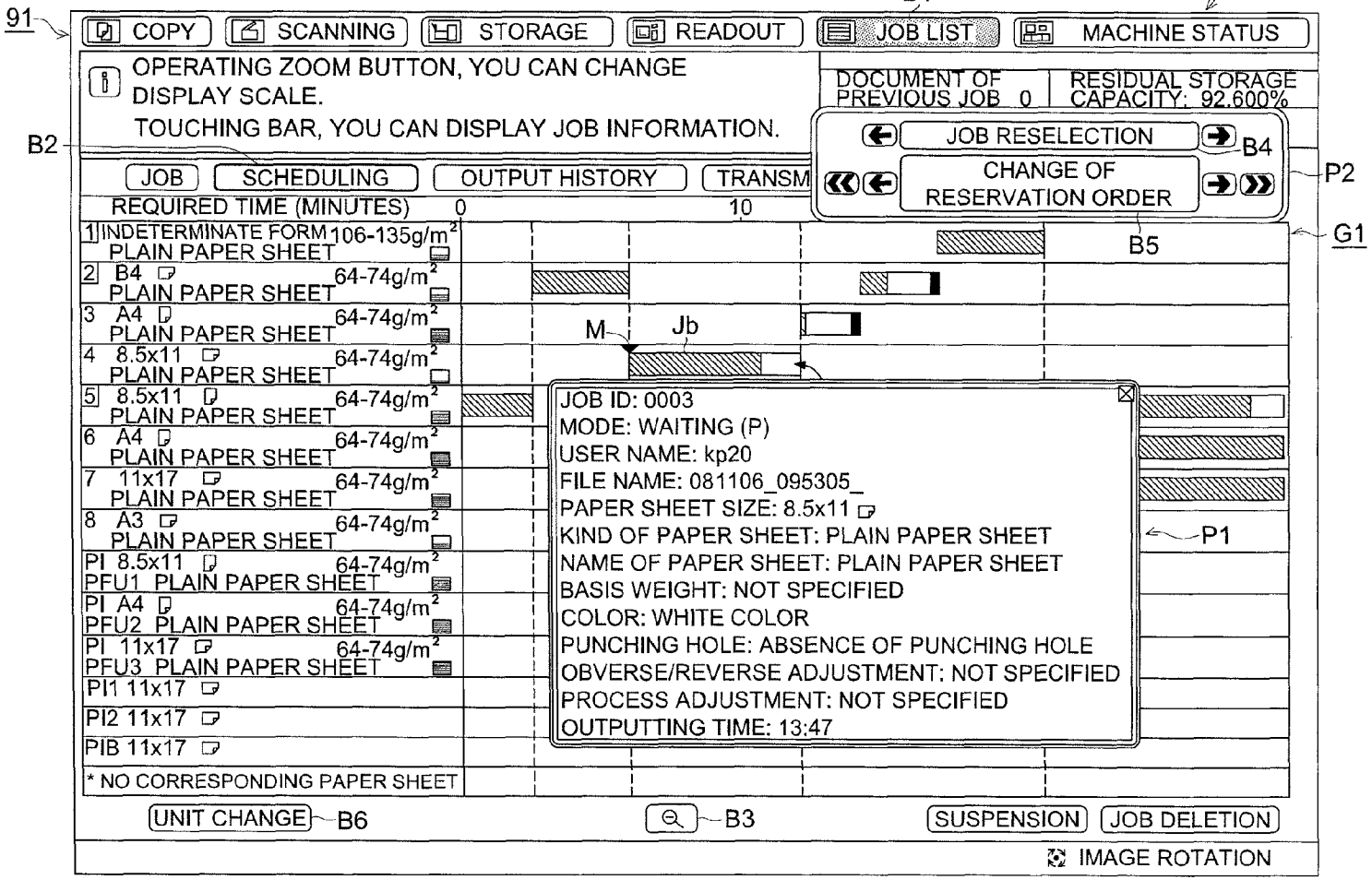
FIG. 4 shows an explanatory schematic diagram indicating a display example of a job schedule screen (second example)

According to the screen display example (second example) of the job schedule screen G1 shown in FIG. 4, the icon buttons, including "UNIT CHANGE", "ZOOMING", "SUSPENSION" and "JOB DELETION", are displayed in the area located at the lower side of the job schedule screen G1. By depressing an icon buttons B6 of "UNIT CHANGE", it is possible to change the required times (minutes), displayed in the job schedule screen G1 shown in FIG. 3, to the time information. According to this time display, it is possible to recognize the commencement time for implementing the reserved job including the waiting mode and/or proofing mode.

By depressing the icon buttons B6 of "UNIT CHANGE", as abovementioned, in addition to the contents of the popup screen P1, including "JOB ID: 0003", "MODE: WAITING MODE (P)", "USER NAME: kp20", "FILE NAME: 081106 095305", "PAPER SHEET SIZE: 8.5×11□ (HORIZONTAL)", "PAPER KIND: PLANE PAPER", "NAME OF PAPER SHEET: PLANE PAPER", "BASIS WEIGHT: NOT SPECIFIED", "COLOR: WHITE", "PUNCH HOLE: ABSENCE OF PUNCH HOLE", "OBVERSE/REVERSE ADJUSTMENT: NOT SPECIFIED" AND "PROCESS ADJUSTMENT: NOT SPECIFIED", for instance, "OUTPUT TIME: 13:47", indicating that the job commencement time is 13 o'clock 47 minutes, is also displayed within the popup screen P1 shown in FIG. 4.

For instance, the output time=13:47 is calculated by adding (accumulating) the residual time of the reserved job currently in mid-course of the print outputting operation, which has been reserved prior to the reserved job including the waiting/proofing mode, to the current time indicated by the clock function provided in the image controlling CPU 5 (engine). According to the above-mentioned calculation, it becomes possible for the user to confirm that the commencement time for implementing the reserved job including the waiting mode, shown in FIG. 3, is equal to 13:47 as its rough estimation, and accordingly, to visually recognize the time, at around which the operator should stay at the site of the machine concerned.

Figure 5:
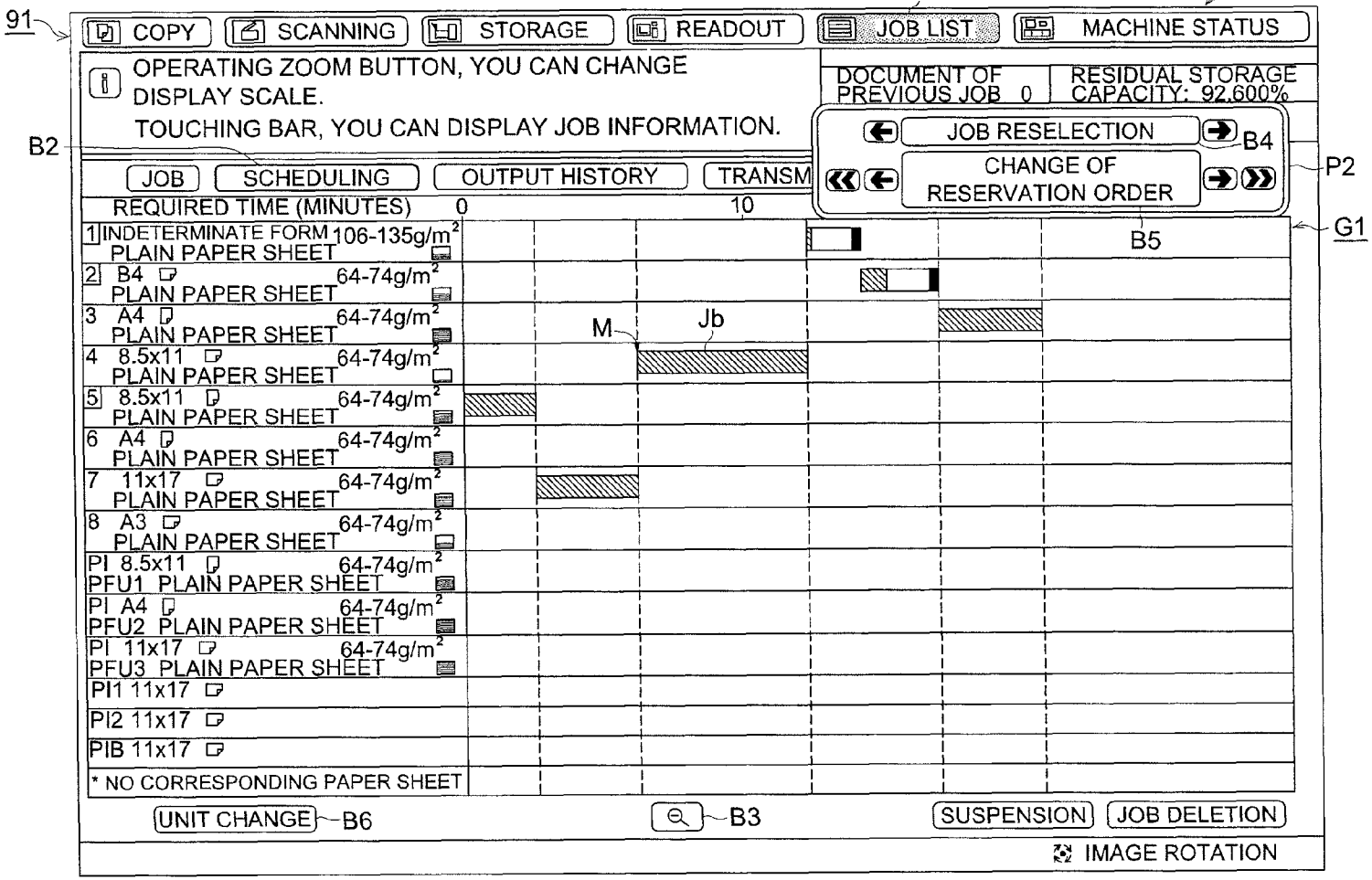
FIG. 5 shows an explanatory schematic diagram indicating a display example of a job schedule screen (third example)
Figure 6:
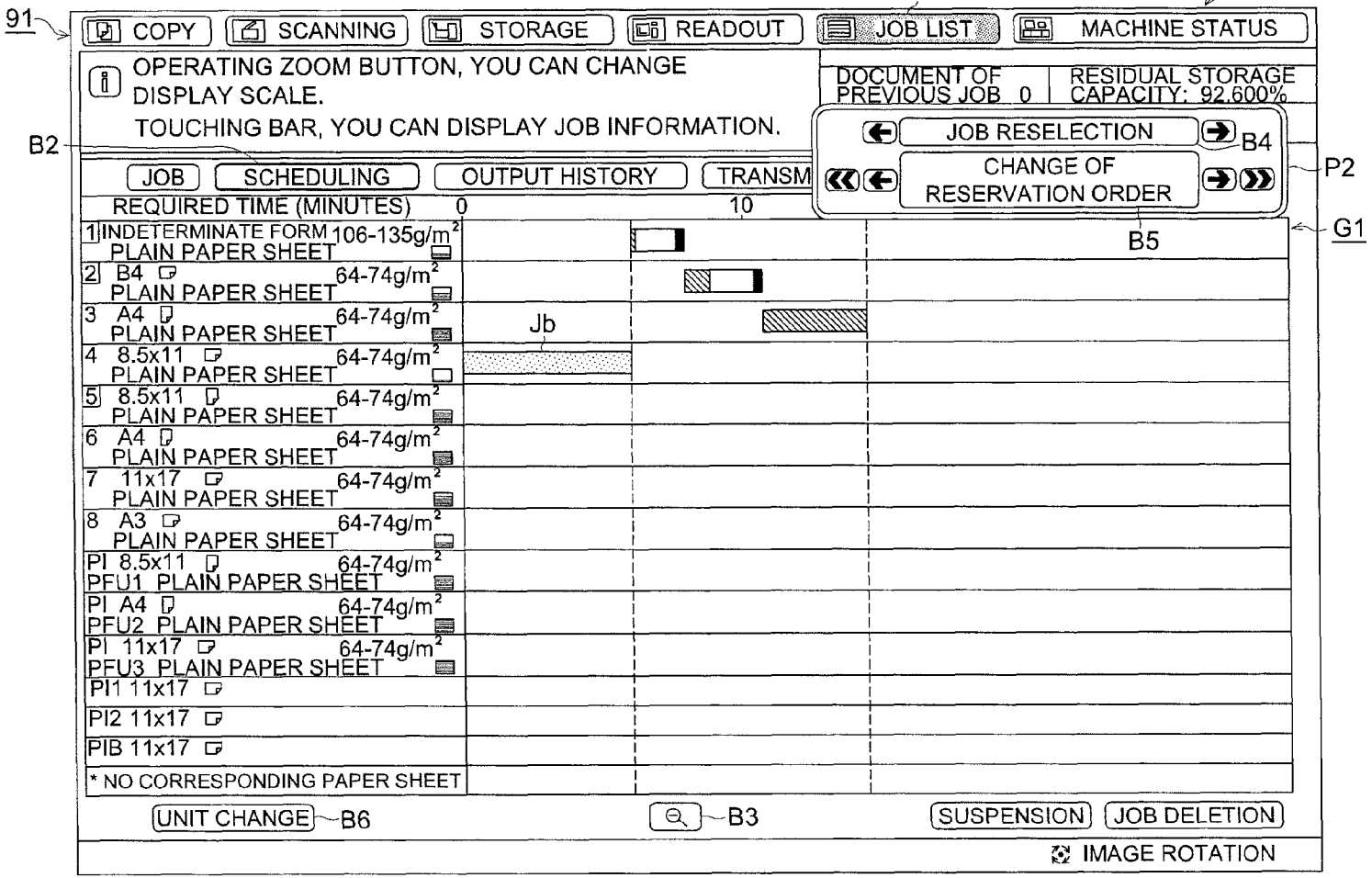
FIG. 6 shows an explanatory schematic diagram indicating a display example of a job schedule screen (fourth example)

According to the screen display example (third example) of the job schedule screen G1 shown in FIG. 5, the reserved job corresponding to the job ID="0003" and including the waiting mode is displayed on the job schedule screen G1 as the third reserved job. After a certain time has elapsed since the above time point, at the time when the print outputting operations of the two reserved jobs, which were reserved prior to the reserved job corresponding to the job ID="0003", have been completed, the reserved job corresponding to the job ID="0003" and including the waiting mode is shifted to the position of the leading top job (also serving as the position of the outputting job), as indicated in the screen display example (fourth example) of the job schedule screen G1 shown in FIG. 6.

In this example, when the reserved job is turned to the outputting job, the red identification mark M indicated by symbol "▼" for indicating the waiting mode, proofing mode, etc., is deleted from the job schedule screen G1. At the same time, since the reserved job corresponding to the job ID="0003" has been shifted to the leading top position, the display color of the job bar Jb is changed to the operation waiting color (color of pink; indicated by an area filed with pearskin pattern in FIG. 6) from the color of the normal job bar Jb (tray residual amount display), and the reserved job concerned is made to wait in the standby state. The reason why the display color of the job bar Jb is changed to the color of pink is to give a precaution to the user concerned.

Next, referring to FIG. 7 through FIG. 9, the job list screen G2 to be developed within the job management screen JG will be detailed in the following. Even in this example, with respect to the reserved job to which the red identification mark M indicated by symbol "▼" shown in FIG. 3 is established and attached, the time information that indicates the time, at which the reserved job concerned is to be commenced, is displayed onto the job list screen G2. For instance, "13:47" that indicates 13 o'clock 47 minutes is displayed as the output commencement time on the line of the reserved job corresponding to the job ID="0003".

According to the screen display example (fourth example) of the job list screen G2 shown in FIG. 7, by depressing (or touching) an icon button B7 of "JOB" displayed on the job schedule screen G1 shown in FIG. 3, the job list screen G2 is displayed on the LCD monitor 91 of the display operating section 9 shown in FIG. 1 and FIG. 2. In the area located at an upper side of the job list screen G2, the various kinds of icon buttons, including "COPY", "SCANNING", "STORING", "READING", "JOB LIST" and "MACHINE STATUS", are displayed in the same manner as in the job schedule screen G1. In this example, since an icon button B7 of "JOB" is depressed in the job schedule screen G1 shown in FIG. 3, the color of the icon button B7 has been turned to the aqua color from the gray color, while the display colors of the other icon buttons are still gray (no change).

In the character display area of the job list screen G2, the character information representing messages of "YOU CAN SELECT ANY ONE OF JOBS ON LIST" and "YOU CAN CONDUCT JOB OPERATION IN REGARD TO SELECTED JOB" are displayed. Further, another display area to be used for displaying the job synopsis list is provided below the character display area abovementioned. In the job synopsis list display area, in addition to the various kinds of icons, including "JOB", "OUTPUT HISTORY", "TRANSMISSION HISTORY", "OUTPUT-PENDING HISTORY", "DEVELOPING STATUS", etc., the job setting information Ds including the job continuous implementation impeding factor is described corresponding to each of the ID (IDentification) information for discriminating the reserved jobs from each other. In the job list screen G2, both the reserved job, which is currently implemented by the printer section 24, and the plurality of other reserved jobs, which are currently in the standby state for waiting its turn, are displayed in a synopsis manner.

In this example, the various kinds of item columns, including "DURING OPERATION", "MODE", "STATUS", "NUMBER OF PAPER SHEETS", "NUMBER OF COPIES", "NUMBER OF RESIDUAL PAPER SHEETS", "TIME (MINUTES)", "USER'S NAME" and "FILE NAME", are allotted to the job list screen G2 as the job setting information Ds. For instance, with respect to the reserved job of "DURING OPERATION" corresponding to the job ID="0010", the job setting information Ds, including "MODE"=printer mode, "STATUS"=mid-course of outputting, "NUMBER OF PAPER SHEETS"=20, "NUMBER OF COPIES"=50, "NUMBER OF RESIDUAL PAPER SHEETS"=100, "TIME (MINUTES)"=1, "USER'S NAME"; <ABCD> and "FILE NAME"; <abcdefg>, is displayed. As well as the above, with respect to the reserved job corresponding to the job ID="0011", the job setting information Ds, including "MODE"=copy mode, "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=9, "USER'S NAME"; <BCDA> and "FILE NAME"; <bcdefga>, is displayed.

Further, with respect to the reserved job corresponding to the job ID="0012", the job setting information Ds, including "MODE"=copy mode, "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=9, "USER'S NAME"; <CDAB> and "FILE NAME"; <cdefgab>, is displayed. Still further, with respect to the reserved job corresponding to the job ID="0013", the job setting information Ds, including "MODE"=waiting mode, "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=13:47, "USER'S NAME"; <DABC> and "FILE NAME"; <defgabc>, is displayed. Reference symbol T shown in FIG. 7 indicates an output commencing time, and currently indicates 13 o'clock 47 minutes serving as the estimated time at which the reserved job including the waiting mode is to be commenced.

Still further, with respect to the reserved job corresponding to the job ID="0014", the job setting information Ds, including "MODE"=copy mode, "STATUS"=outputting enable, "NUMBER OF PAPER SHEETS"=10, "NUMBER OF COPIES"=40, "NUMBER OF RESIDUAL PAPER SHEETS"=400, "TIME (MINUTES)"=7, "USER'S NAME"; <BACD> and "FILE NAME"; <efgabcd>, is displayed. Still further, with respect to the reserved job corresponding to the job ID="0015", the job setting information Ds, including "MODE"=printer mode, "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=9, "USER'S NAME"; <ABDC> and "FILE NAME"; <fgabcde>, is displayed.

Still further, with respect to the reserved job corresponding to the job ID="0016", the job setting information Ds, including "MODE"=copy mode, "STATUS"=outputting enable, "NUMBER OF PAPER SHEETS"=20, "NUMBER OF COPIES"=40, "NUMBER OF RESIDUAL PAPER SHEETS"=800, "TIME (MINUTES)"=7, "USER'S NAME"; <ACBD> and "FILE NAME"; <gabcdef>, is displayed. Still further, with respect to the reserved job corresponding to the job ID="0017", the job setting information Ds, including "MODE"=copy mode, "STATUS"=paper sheet reservation, "NUMBER OF PAPER SHEETS"=20, "NUMBER OF COPIES"=50, "NUMBER OF RESIDUAL PAPER SHEETS"=1000, "TIME (MINUTES)"=9, "USER'S NAME"; <DBCA> and "FILE NAME"; <gbcdefa>, is displayed. Still further, with respect to the reserved job corresponding to the job ID="0018", the job setting information Ds, including "MODE"=printer mode, "STATUS"=mid-course of receiving, "NUMBER OF PAPER SHEETS"=20, "NUMBER OF COPIES"=40, "NUMBER OF RESIDUAL PAPER SHEETS"=800, "TIME (MINUTES)"=7, "USER'S NAME"; <ADCB> and "FILE NAME"; <acdefgb>, is displayed.

In this connection, for instance, the reserved job corresponding to the job ID="0017", in which ["STATUS"=PAPER SHEET RESERVATION] is established, is such a job that will be stopped at the time when the size and kind of paper sheets, accommodated in the paper sheet tray, do not coincide with those established. Further, since, according to the paper sheet information of the paper sheets currently loaded into the paper sheet tray, the size and kind of paper sheets are different from those required, it is necessary to implement the operation for establishing the items of the paper sheet tray. In this case, the job bar Jb of the paper sheet tray is displayed in a color (orange color or Chinese red color in this example) being different from that of the residual number of paper sheets, so as to make the user recognize that the establishment is different from the current paper sheet information. According to the abovementioned color change of the job bar Jb, it becomes possible for the user to confirm the timing of the machine stoppage beforehand.

Yet further, with respect to the reserved job corresponding to the job ID="0019", the job setting information Ds, including "MODE"=proofing mode (P), "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=14:35, "USER'S NAME"; <CBAD> and "FILE NAME"; <abcedfg>, is displayed. Since the time information is displayed on the job list screen G2 in such a manner as abovementioned, it becomes possible for the operator (user) to visually recognize the suitable time when the operator should stay at the machine side concerned.

In this example, the system is so constituted that it is possible to conduct the operation for reshuffling the reserved jobs within the job list screen G2 and the operation for shifting the reserved job between the job list screen G2 and a job suspension screen G3.

In the job suspension screen G3, for instance, with respect to the reserved job corresponding to the suspended job ID="0001", the job setting information Ds, including "MODE"=printer mode (P), "STATUS"=mid-course of suspension, "NUMBER OF PAPER SHEETS"=1000, "NUMBER OF COPIES"=1000, "NUMBER OF RESIDUAL PAPER SHEETS" 1000, "TIME (MINUTES)", "USER'S NAME"; <ABCD> and "FILE NAME"; <abcdefg>, is displayed. Further, as well as the above, with respect to the reserved job corresponding to the suspended job ID="0002", the job setting information Ds, including "MODE"=copy mode, "STATUS"=mid-course of suspension, "NUMBER OF PAPER SHEETS"=1000, "NUMBER OF COPIES" 1000, "NUMBER OF RESIDUAL PAPER SHEETS"=1000, "TIME (MINUTES)", "USER'S NAME"; <BCDA> and "FILE NAME"; <bcdefga>, is displayed.

Still further, with respect to the reserved job corresponding to the suspended job ID="0003", the job setting information Ds, including "MODE"=printer mode, "STATUS"=mid-course of suspension, "NUMBER OF PAPER SHEETS"=1000, "NUMBER OF COPIES"=1000, "NUMBER OF RESIDUAL PAPER SHEETS"=1000, "TIME (MINUTES)", "USER'S NAME"; <CDAB> and "FILE NAME"; <cdefgab>, is displayed. Still further, with respect to the reserved job corresponding to the suspended job ID="0004", the job setting information Ds, including "MODE"=printer mode, "STATUS"=mid-course of suspension, "NUMBER OF PAPER SHEETS"=1000, "NUMBER OF COPIES"=1000, "NUMBER OF RESIDUAL PAPER SHEETS"=1000, "TIME (MINUTES)", "USER'S NAME"; <DABC> and "FILE NAME"; <defgabc>, is displayed. Yet further, with respect to the reserved job corresponding to the suspended job ID="0005", the job setting information Ds, including "MODE"=copy mode, "STATUS"=mid-course of suspension, "NUMBER OF PAPER SHEETS"=1000, "NUMBER OF COPIES"=1000, "NUMBER OF RESIDUAL PAPER SHEETS"=1000, "TIME (MINUTES)", "USER'S NAME"; <BACD> and "FILE NAME"; <efgabcd>, is displayed.

In the right side area of the job list screen G2, various kinds of icon buttons, including "SETTING CHANGE", "DETAIL", "PREFERENTIAL OUTPUT", "PREFERENCE", "SUSPENSION" and "DELETION". Further, in the right side area of the job list screen G2, other various kinds of icon buttons, including "TICHET EDITION", "SUSPENSION RELEASE" and "ALL RELEASE".

In this example, by depressing a single or plural button(s) selected from the above-mentioned buttons including "SETTING CHANGE", "DETAIL", "PREFERENTIAL OUTPUT", "PREFERENCE", "SUSPENSION", "DELETION", "TICHET EDITION", "SUSPENSION RELEASE", "ALL RELEASE", etc., it becomes possible to conduct the operation for reshuffling the reserved jobs within the job list screen. G2 and the operation for shifting the reserved job between the job list screen G2 and a job suspension screen G3.

In this example, the reserved job attached with the red identification mark M indicated by symbol "▼", shown in FIG. 3, etc., and the other reserved jobs to be displayed in the synopsis manner are displayed separately in different colors on the job list screen G2. In the abovementioned example, with respect to the reserved job corresponding to the job ID="0013", the job setting information Ds, including "MODE"=waiting mode (P), "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=13:47, "USER'S NAME"; <DABC> and "FILE NAME"; <defgabc>, and, with respect to the reserved job corresponding to the job ID="0017", the job setting information Ds, including "MODE"=copy mode, "STATUS"=paper sheet reservation, "NUMBER OF PAPER SHEETS"=20, "NUMBER OF COPIES"=50, "NUMBER OF RESIDUAL PAPER SHEETS"=1000, "TIME (MINUTES)"=9, "USER'S NAME"; <DBCA> and "FILE NAME"; <gbcdefa>, are displayed by using red color characters (bold characters in the drawings, as a matter of convenience) written on the bluish black color background (white color background in the drawings, as a matter of convenience).

On the other hand, with respect to each of the reserved jobs respectively corresponding to the job IDs="0010", "0011", "0012", "0014" through "0016" and "0018", the job setting information Ds is displayed by using white color characters written on the bluish black color background being same as the above. The reason why the abovementioned color-coded display method is employed, is to make the user give attention to the specific reserved job including the waiting mode, the proofing mode and the status of paper sheet reservation. Since the reserved jobs are displayed on the job list screen G2 by employing the color-coded display method as abovementioned, it becomes possible for the user to easily recognize the specific reserved job including the waiting mode, the proofing mode, etc., during continuous outputting operations of a large number of print jobs reserved in advance.

Figure 8:
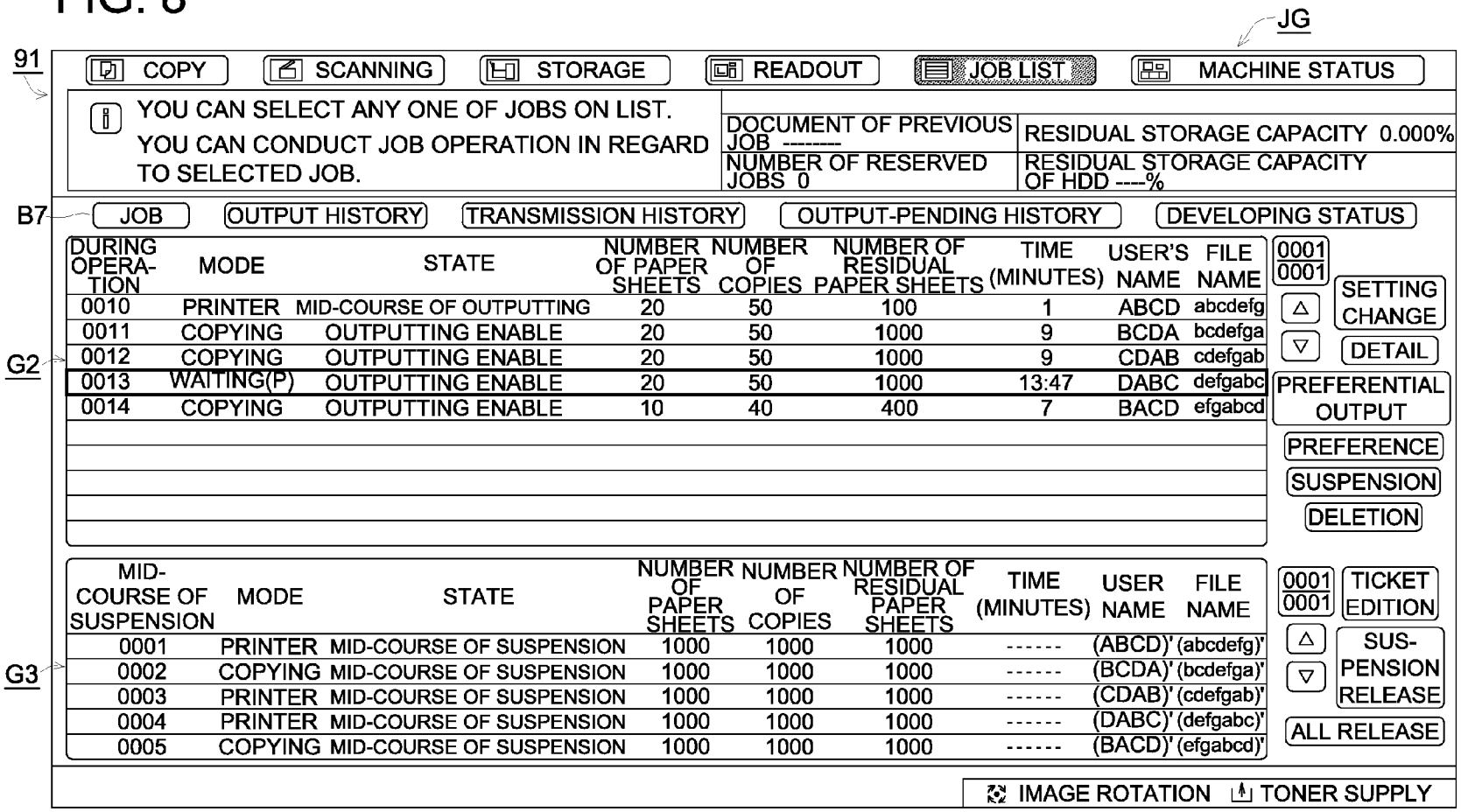
FIG. 8 shows an explanatory schematic diagram indicating a display example of a job list screen (sixth example)
Figure 9:
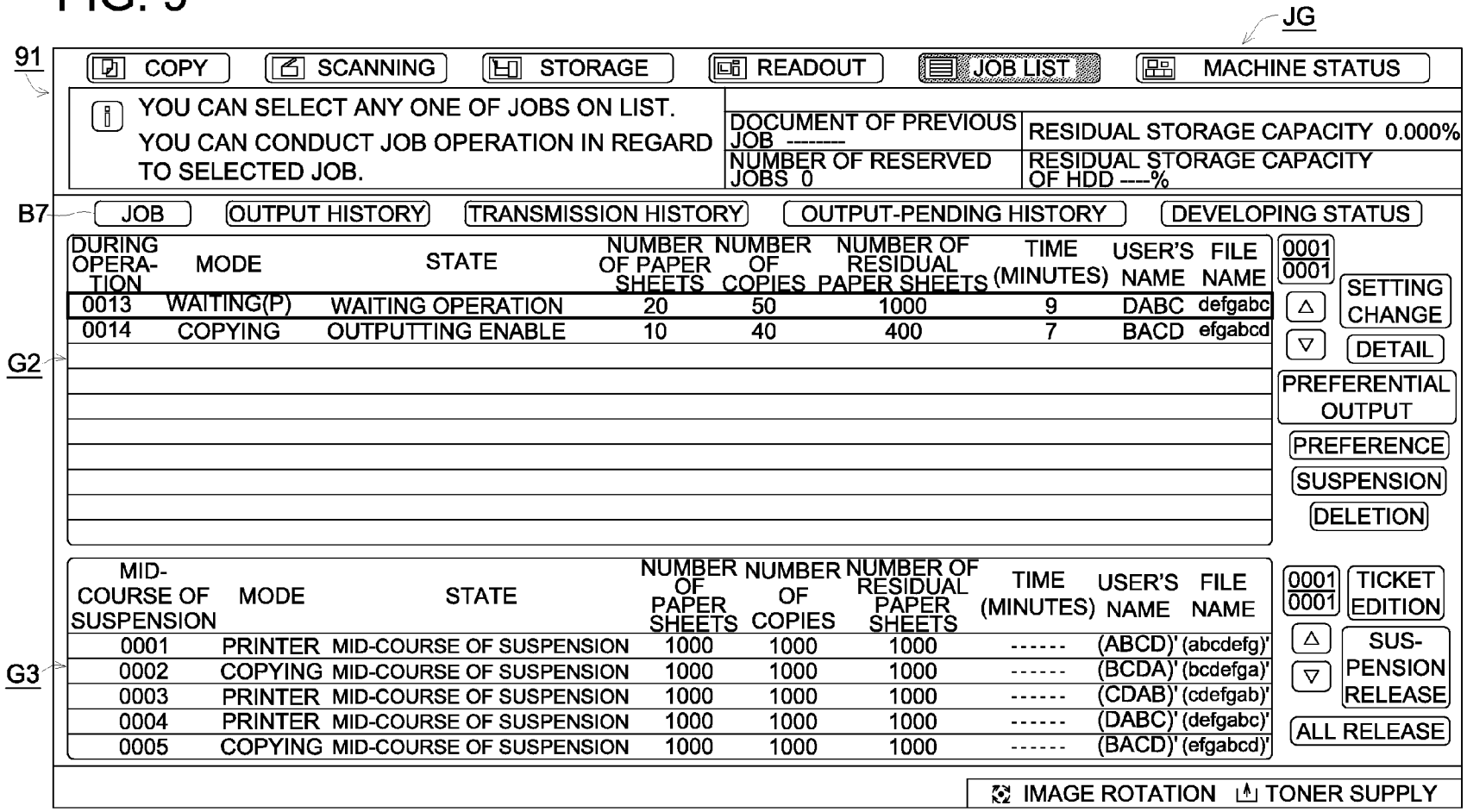
FIG. 9 shows an explanatory schematic diagram indicating a display example of a job schedule screen (seventh example)

In this example, when the reserved job attached with the red identification mark M indicated by symbol "▼", shown in FIG. 3, or the like, is positioned at a top leading line of the job list screen G2, namely, when the reserved job corresponding to the job ID="0013" is positioned at the top leading line in the example shown in FIG. 8, the concerned reserved job is displayed in such a manner that is different from that for displaying the other reserved job corresponding to the job ID="0014", which is not positioned at the top leading position.

According to the screen display example (fifth example) of the job list screen G2 shown in FIG. 8, the reserved job corresponding to the job ID="0013" and including the waiting mode is displayed on the fourth line of the job list screen G2 as the fourth reserved job. After the time has elapsed from the abovementioned status, at the time when the print outputting operations of all of the three reserved jobs, which were reserved prior to the reserved job corresponding to the job ID="0013", have been completed, the reserved job corresponding to the job ID="0013" and including the waiting mode is shifted to the top leading line, as indicated in the screen display example (sixth example) of the job list screen G2 shown in FIG. 9

In this example, when the reserved job corresponding to the job ID="0013" is turned to the output job, the displaying mode of the job setting information Ds, including "MODE"=waiting mode (P), "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=13:47, "USER'S NAME"; <DABC> and "FILE NAME"; <defgabc>, and displayed by using the red color characters written on the black color background, is changed to another displaying mode, for instance, in such a manner that the characters of the machine stoppage color (red color) are changed to those of the orange color, indicating the standby status for waiting an operation. Further, since the reserved job is changed to the output job, the concerned status is also changed to <waiting operation> from <outputting enable>. Still further, the time (minutes), shown in FIG. 7, is also changed (rewritten) to <time display=9> form <commencement time display=13:47>.

As abovementioned, by displaying the concerned reserved job in the different manner, compared to the displaying manner in such the case that the concerned reserved job is not positioned at the top leading line on the job list screen G2, it becomes possible for the user to easily recognize the arrival of the specific reserved job including the waiting mode, the proofing mode, etc., during continuous outputting operations of a large number of print jobs reserved in advance.

Next, referring to FIG. 10*a* through FIG. 10*d*, an example of a print queue controlling operation and an exemplified data format of a print job, both of which are to be employed for job management operations, will be detailed in the following. According to the example of the print queue controlling operation shown in FIG. 10*a*, for instance, when four print jobs are managed, job data Dj is established for every print job. In this example, the printing operation of the print job (implementation job) is implemented in order of the print jobs from the initially registered print job to the secondary registered print job. The secondary registered print job and the other print jobs registered after the secondary registered print job are reserved (reserved jobs). The operations for managing the implementation job and the reserved jobs, abovementioned, are controlled by using the print queue.

The print queue is a kind of software for storing jobs generated by the print spooler. For instance, when the job management operations are implemented, the print queue is represented by "Print queue"→"Print: print job"→"Print: print job (reservation)"→"Print: print job (reservation)"→"Print: print job (reservation)".

According to the exemplified format of the job data Dj, the print job is structured by adding header information HD to the image data D1. Further, the header information HD is constituted by the job ID and the job setting information Ds. The job setting information Ds, shown in FIG. 10*c*, includes "ONE-SIDE/DUPLEX", "TRAYS TO BE USED", "OUTPUT MODE", "RESIDUAL TIME INFORMATION", "STATUS", "NUMBER OF PAPER SHEETS", "NUMBER OF COPIES", "NUMBER OF RESIDUAL PAPER SHEETS", "USER'S NAME", "FILE NAME", etc.

Figures 10A, 10B, 10C, 10D:
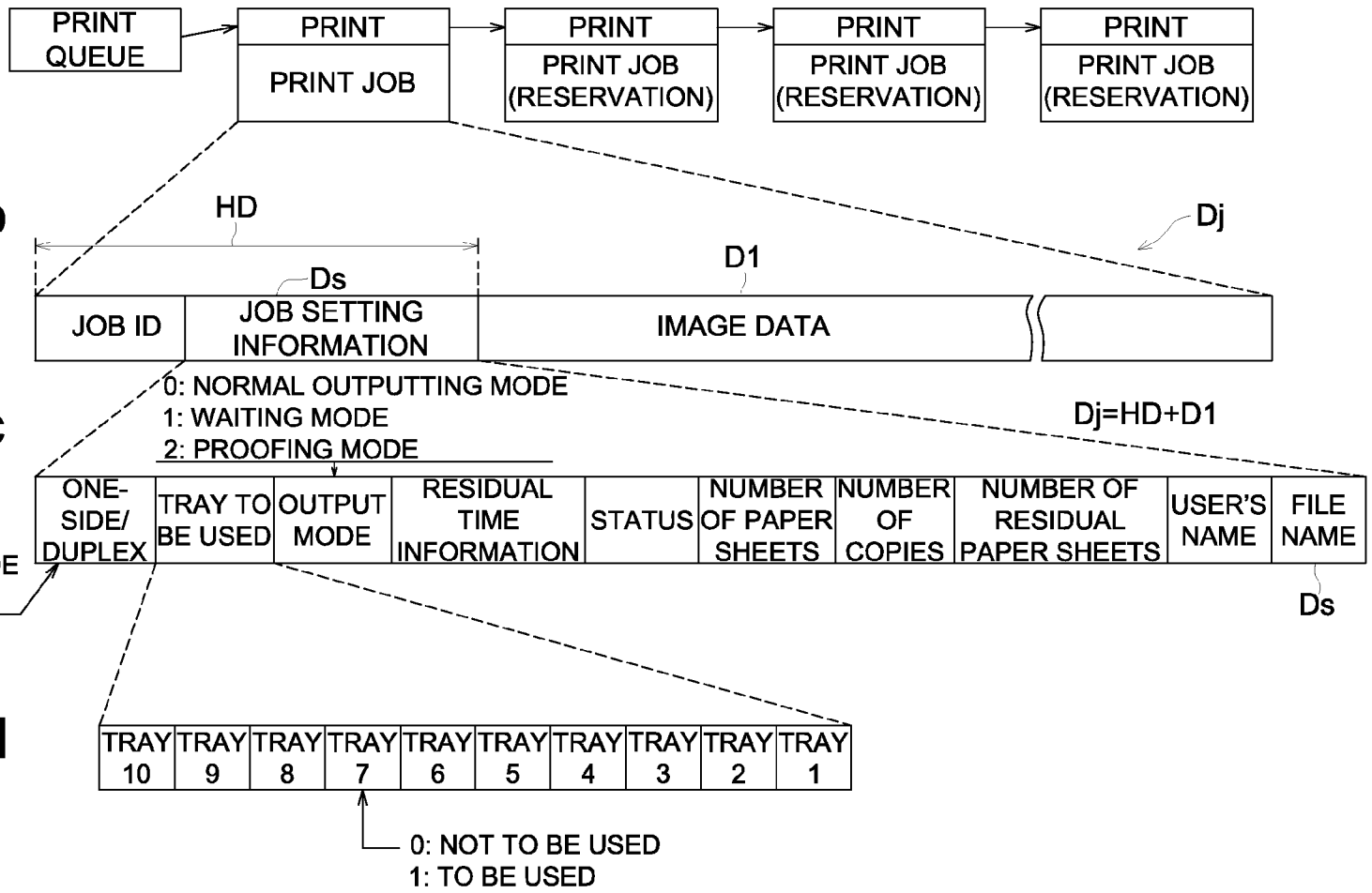
FIG. 10*a*, FIG. 10*b*, FIG. 10*c* and FIG. 10*d*, show explanatory schematic diagrams indicating an example of a print queue controlling operation and an exemplified data format of a print job.

In this example, when the one side printing mode is established with respect to the column of "ONE-SIDE/DUPLEX", the column is filled with numeral "0", while, when the duplex printing mode is established, the column is filled with numeral "1". Further, for instance as shown in FIG. 10*d*, ten trays, including tray 1 through tray 10, are provided in the column of "TRAYS TO BE USED". With respect to the using status of the tray 7, if the tray is not to be used, the column is filled with numeral "0", while, if the tray is to be used, the column is filled with numeral "1".

Still further, for instance as shown in FIG. 10*c*, three modes, including the normal printing mode, the waiting mode and the proofing mode, are provided in the column of "OUTPUT MODE". When the normal printing mode is established as the "OUTPUT MODE", the column is filled with numeral "0", while, when the waiting mode is established as the "OUTPUT MODE", the column is filled with numeral "1", still while, when the proofing mode is established as the "OUTPUT MODE", the column is filled with numeral "2".

Still further, the column of the "RESIDUAL TIME INFORMATION" is filled with a numerical value of; for instance, "13:47", acquired by conducting the calculation of the residual time. The column of the "STATUS" is filled with any one of "mid-course of outputting", "outputting enable", "paper sheet reservation" and "mid-course of receiving", each of which indicates the operating status of the printer section 24. The column of the "NUMBER OF PAPER SHEETS" is filled with "number of paper sheets" to be printed, for instance, "20", "10", etc. The column of the "NUMBER OF COPIES" is filled with "number of copies" to be produced, for instance, "40", "50", etc.

The column of the "NUMBER OF RESIDUAL PAPER SHEETS" is filled with an accumulated value of the "NUMBER OF PAPER SHEETS" and the "NUMBER OF COPIES", for instance, "800", "500", etc. The column of the "USER'S NAME" is filled with the name of user concerned. The column of the "FILE NAME" is filled with the name of file concerned. According to the abovementioned process, the job data Dj (=D1+Ds), serving as the print job, etc., which includes the waiting mode, the proofing mode, etc., is structured.

Next, referring to FIG. 11 through FIG. 13, a print queue operating example of a job will be detailed in the following.

Figure 11:
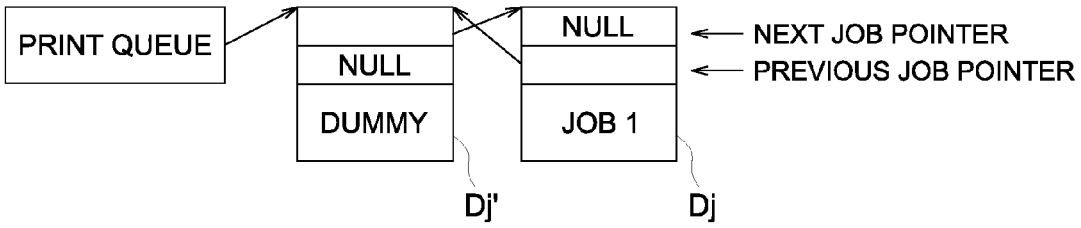
FIG. 11 shows a schematic diagram indicating a print queue operating example.

FIG. 11 shows a schematic diagram indicating a print queue operating example, which employs a bilateral linear list structure as the fundamental structure of the print queue. According to the bilateral linear list structure, when a pointer toward the next job is absent (NULL), it is indicated that the concerned job (JOB 1) is the last job. Further, a dummy (DUMMY) of job data Dj, which indicates a top leading position of the print queue, is disposed at the top leading position, and an absence of job (NULL) is set for a pointer toward the previous job of the dummy job, which is generated at the time of activating the apparatus main body 12.

Figure 12A:
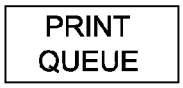
FIG. 12*a*, FIG. 12*b* and FIG. 12*c* show explanatory schematic diagrams indicating other print queue operating examples.
Figure 12B:
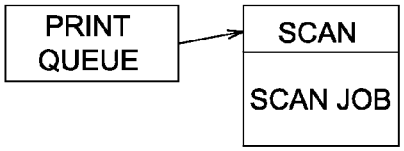
Figure 12C:
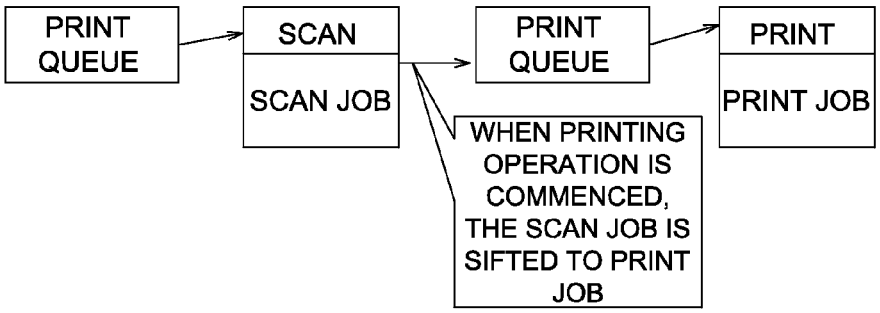

According to the print queue operating example shown in FIG. 12*a*, the state of job absence is represented by "Print queue". In this connection, with respect to the dummy job, its explanation is omitted herein. According to the print queue operating example shown in FIG. 12*b*, the state that the copy (scanning) operation has been commenced is represented by "Print queue"→"Scan: scan job". According to the print queue operating example shown in FIG. 12*c*, the state that the copy (printing) operation has been commenced is represented by "Print queue"→"Scan: scan job"→"Print queue"→"Print: print job". When the printing operation is commenced, the scan job is sifted to the print job.

Figures 13A, 13B, 13C:
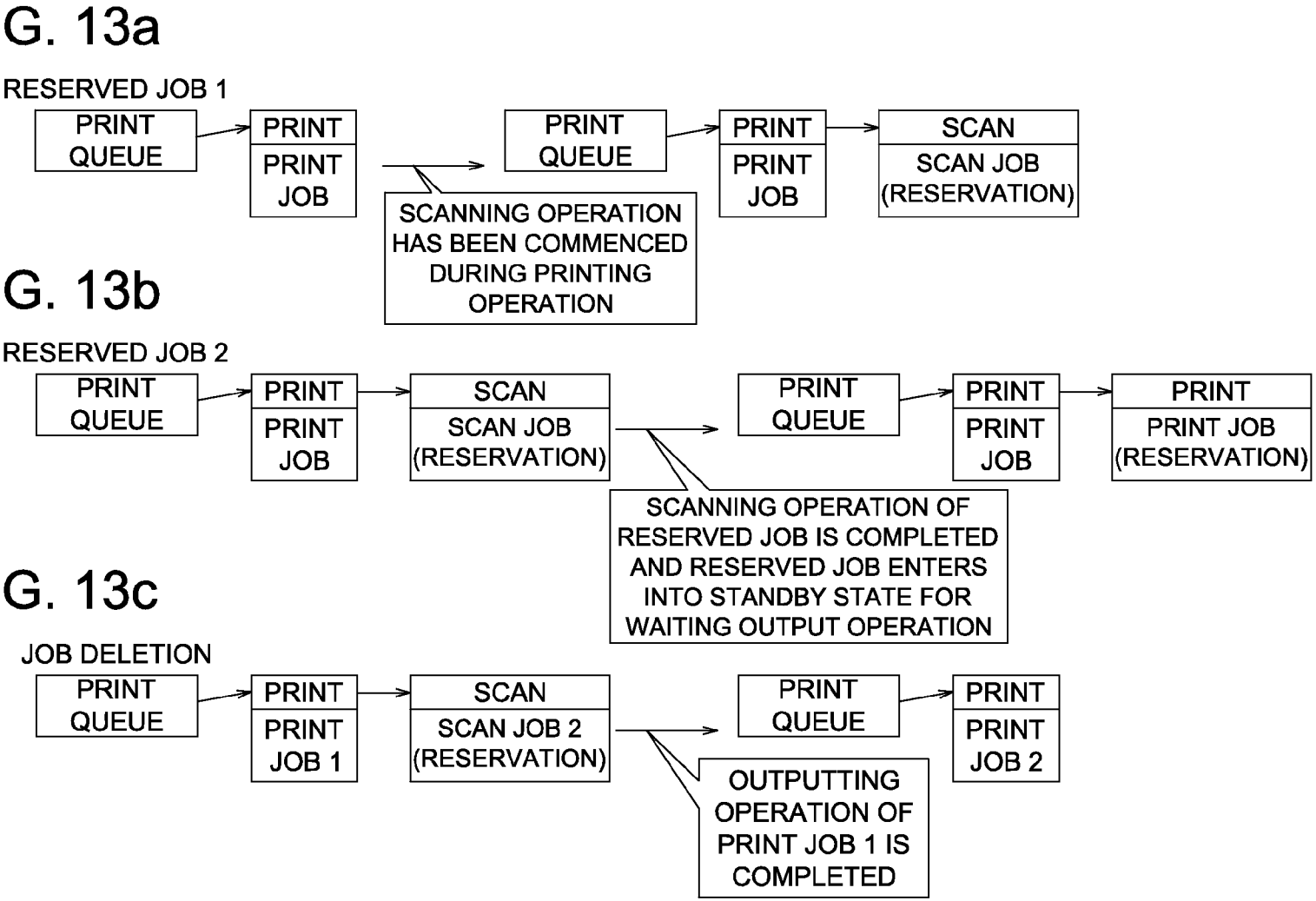
FIG. 13*a*, FIG. 13*b* and FIG. 13*c* show explanatory schematic diagrams indicating still other print queue operating examples.

According to the print queue operating example shown in FIG. 13*a*, the state that the copy (printing) operation has been commenced is represented by "Print queue"→"Print: print job". In this connection, the state that the scanning operation has been commenced during the printing operation, and further, the reserved job 1 is accepted, is represented by "Print queue"→"Print: print job"→"Scan: scan job (reservation)".

According to the print queue operating example shown in FIG. 13*b*, the state that the copy (printing) operation has been commenced, and further, the scanning operation of the reserved job is commenced, is represented by "Print queue"→"Print: print job"→"Scan: scan job (reservation). Successively, the scanning operation of the reserved job is completed and the reserved job enters into the standby state for waiting the output operation. Then, the state that the copy (printing) operation has been commenced, and further the reserved job 2 is accepted, is represented by "Print queue"→"Print: print job" "Print: print job (reservation)". In this connection, such the case that the job continuous implementation impeding factor, such as the waiting mode, the proofing mode, etc., is included into the job setting information Ds of the print job (reservation), is the object of this example.

According to the print queue operating example shown in FIG. 13*c*, when the concerned job is deleted, the state that the copy (printing) operation of the print job 1 has been commenced, and further, the printing operation of the print job 2 (reservation) is commenced, is represented by "Print queue"→"Print: print job 1"→"Print: print job 2 (reservation). Successively, the outputting operation of the print job 1 is completed. In this connection, the state that the print job 1 is deleted is represented by "Print queue"→"Print: print job 2". As described in the foregoing, by operation the print queue, it becomes possible to control the implementation job and the reserved job.

Next, referring to FIG. 14 through FIG. 16, display controlling examples of the digital MFP 100, embodied in the present invention, will be detailed in the following. This example is performed during continuous print-outputting operations in such a case that a large number of print jobs are reserved in advance and the waiting mode, the proofing mode or the like is included in some of the reserved jobs concerned. The three display controlling examples of the reserved jobs, respectively corresponding to at the time of accepting the job, at the time of completing the job and at the time of the waiting mode, the proofing mode or the like, will be separately detailed in the following.

Hereinafter, it is premised that: the processing for forming an image onto the paper sheet S, based on the predetermined image data D1 and the job setting information Ds, in the digital MFP 100, is defined as the print job; the impeding factor, occurring when the plurality of print jobs are continuously implemented in the digital MFP 100, is defined as the job continuous implementation impeding factor; and the processing for attaching (establishing) the job setting information Ds, including the job continuous implementation impeding factor, such as the waiting mode, the proofing mode, the paper sheet reservation, etc., to the image data D1 and registering it, is defined as the reserved job.

<Display Controlling Example at Time of Accepting Job>

Figure 14:
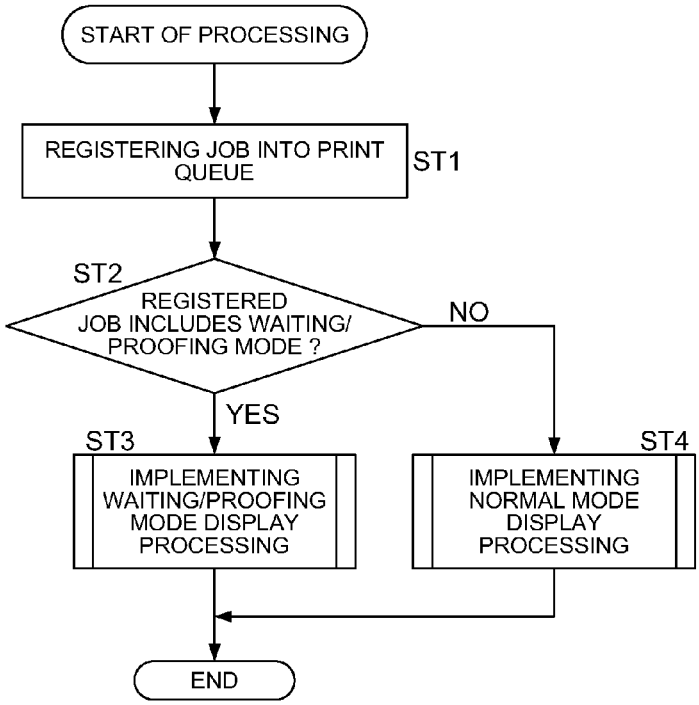
FIG. 14 shows a flowchart indicating a display controlling example to be conducted when accepting a job.

According to the flowchart, shown in FIG. 14, indicating a display controlling example at the time of accepting the job, in Step ST1, the job is registered into the "Print queue". At this time, plural reserved jobs are accepted in the digital MFP 100 by using the display operating section 9. The user reserves a large number of print jobs, and establishes a specific print job associated with the waiting mode, the proofing mode, the paper sheet reservation or the like, to be performed during the continuous print-outputting operations (refer to the schematic diagrams shown in FIG. 13*a* and FIG. 13*b*).

Successively, in Step ST2, the image controlling CPU 5 determines whether the registered job is such a job that includes the job continuous implementation impeding factor, such as the waiting mode, the proofing mode, the paper sheet reservation or the like, or a normal job to be implemented in the normal operating mode. At this time, the image controlling CPU 5 extracts the specific reserved job that includes the job continuous implementation impeding factor, such as the waiting mode, the proofing mode, the paper sheet reservation or the like, from the reserved jobs previously accepted in Step ST1. By decoding (parsing) the header information HD of the job data Dj, shown in FIG. 10*h*, it is determined whether or not the concerned job is the specific reserved job that includes the job continuous implementation impeding factor. The image controlling CPU 5 establishes (attaches) the red identification mark M, indicated by symbol "▼" for indicating the job continuous implementation impeding factor, to the reserved job above-extracted as the displayable discrimination information.

Successively, when determining that the registered job includes any one of the waiting mode, the proofing mode, the paper sheet reservation, or the like, the image controlling CPU 5 sifts the processing to Step ST3, so as to implement the waiting/proofing mode display processing, which corresponds to the waiting mode, the proofing mode, the paper sheet reservation, etc. At this time, the image controlling CPU 5 controls the LCD monitor 91 so as to display both the reserved job for which the red identification mark M is established, and the other reserved job for which the red identification mark M concerned is not established, onto the job schedule screen G1 in a synopsis manner.

Under the controlling operations conducted by the image controlling CPU 5, the LCD monitor 91 receives the display data D91 sent from the image controlling CPU 5, and displays both the reserved job for which the red identification mark M indicated by symbol "▼" is established, and the other reserved job for which the red identification mark M concerned is not established, onto the job schedule screen G1 in the synopsis manner, based on the display data D91 currently received (refer to FIG. 3).

When determining that the job, registered in the print queue abovementioned, includes none of the waiting mode, the proofing mode, the paper sheet reservation, or the like, the image controlling CPU 5 sifts the processing to Step ST4, so as to implement the normal mode display processing. Accordingly, during the continuous outputting operations of a large number of print jobs reserved in advance, it becomes possible for the operator (user) to visually recognize the suitable time when the operator should stay at the machine side concerned, even if the reserved job includes the job continuous implementation impeding factor, such as the waiting mode, the proofing mode, etc.

<Display Controlling Example at Time of Job Finalization>

Figure 15:
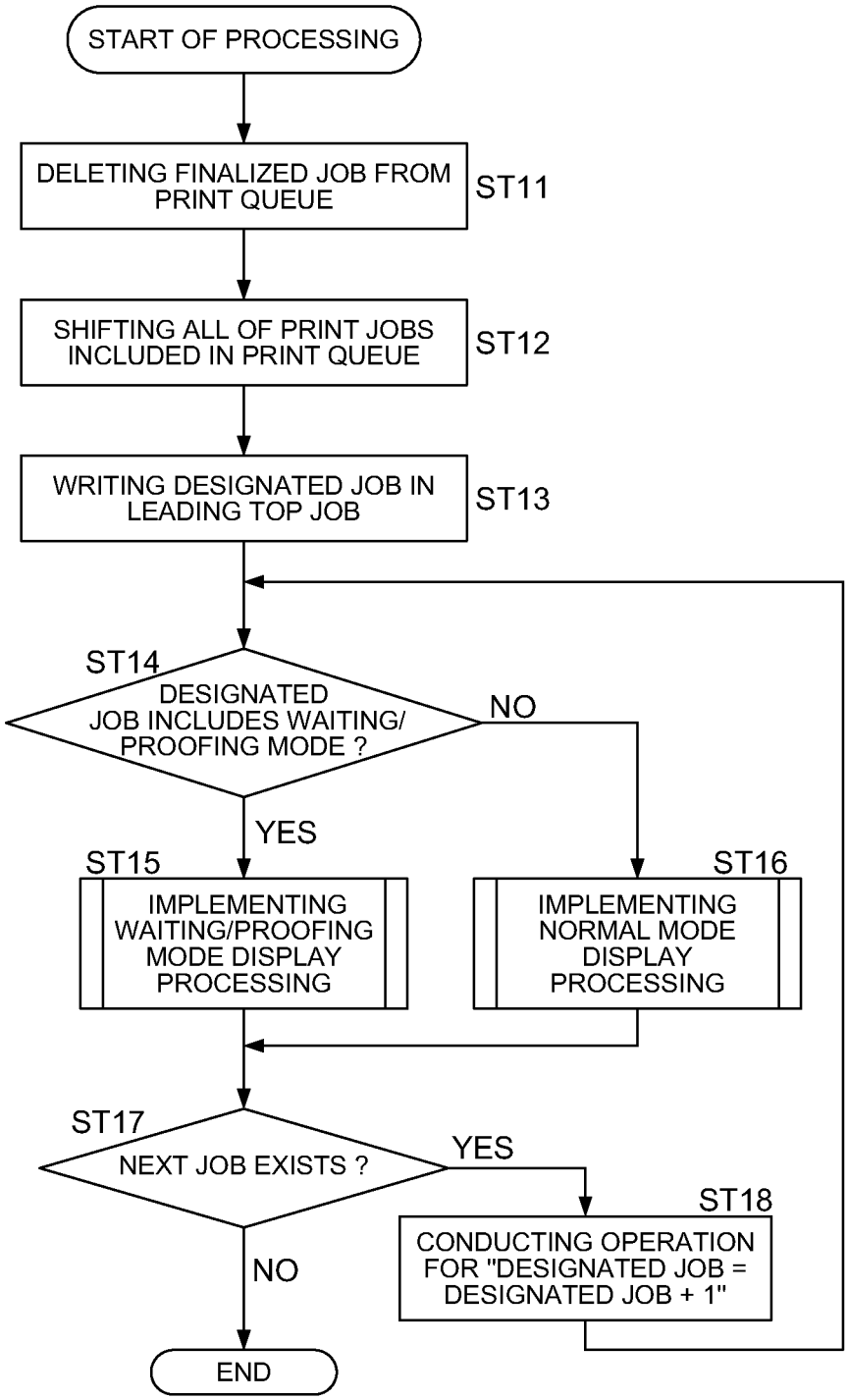
FIG. 15 shows a flowchart indicating a display controlling example to be conducted when finalizing a job.

Further, according to an example of the display controlling operation at the time of the job finalization shown in FIG. 15, in Step ST11, implementing the registered print job, the image controlling CPU 5 deletes the finalized job from the print queue (refer to FIG. 13*c*).

Successively, in Step ST12, the image controlling CPU 5 shifts the all of the print jobs in the print queue. In this connection, as indicated in the description contents of the job deletion shown in FIG. 13*c*, the image controlling CPU 5 initially deletes the job ranked at the leading top position, and then, makes the next job raise to the leading top position, and further, makes the other lower ranked jobs sift up so as to raise their ranks by one.

Still successively, in Step ST13, the image controlling CPU 5 writes a job designated by the print queue (hereinafter, referred to as a designated job) in the leading top job. Then, in Step ST14, the image controlling CPU 5 determines whether the designated job includes the waiting/proofing mode or the normal operating mode only. At this time, the image controlling CPU 5 employs the determining method shown in FIG. 10*b*, namely, the determining operation is achieved by decoding (parsing) the header information HD of the job data Dj (refer to Step ST2).

Still successively, when determining that the designated job includes the waiting/proofing mode, the image controlling CPU 5 sifts the processing to Step ST15, so as to implement the waiting/proofing mode display processing, which corresponds to the waiting mode, the proofing mode, the paper sheet reservation, etc. At this time, the image controlling CPU 5 controls the LCD monitor 91 so as to display both the reserved job for which the red identification mark M is established, and the other reserved job for which the red identification mark M concerned is not established, onto the job schedule screen G1 in the synopsis manner.

Under the controlling operations conducted by the image controlling CPU 5, the LCD monitor 91 receives the display data D91 sent from the image controlling CPU 5, and displays both the reserved job for which the red identification mark M indicated by symbol "▼" is established, and the other reserved job for which the red identification mark M concerned is not established, onto the job schedule screen G1 in the synopsis manner, based on the display data D91 currently received (refer to FIG. 3). After that, the image controlling CPU 5 shift the processing to Step ST17.

When determining that the job, registered in the print queue abovementioned, includes none of the waiting mode, the proofing mode, the paper sheet reservation, or the like, the image controlling CPU 5 sifts the processing to Step ST16, so as to implement the normal mode display processing.

After that, shifting the processing to Step ST17, the image controlling CPU 5 determines whether or not the next job exists. When determining that the next job exists, the image controlling CPU 5 shift the processing to Step ST18, to conduct an incremental processing, such as an operation for "designated job−designated job+1" or the like. After that, the image controlling CPU 5 make the processing return to Step ST14, so as to repeat the abovementioned processing. On the other hand, when determining that the next job does not exist, the image controlling CPU 5 finalizes the processing. Accordingly, during the continuous outputting operations of a large number of print jobs reserved in advance, it becomes possible for the operator (user) to visually recognize the suitable time when the operator should stay at the machine side concerned, even if the reserved job includes the job continuous implementation impeding factor, such as the waiting mode, the proofing mode, etc.

<Display Controlling Example of Reserved Job Including Waiting/Proofing Mode, Etc.>

Figure 16:
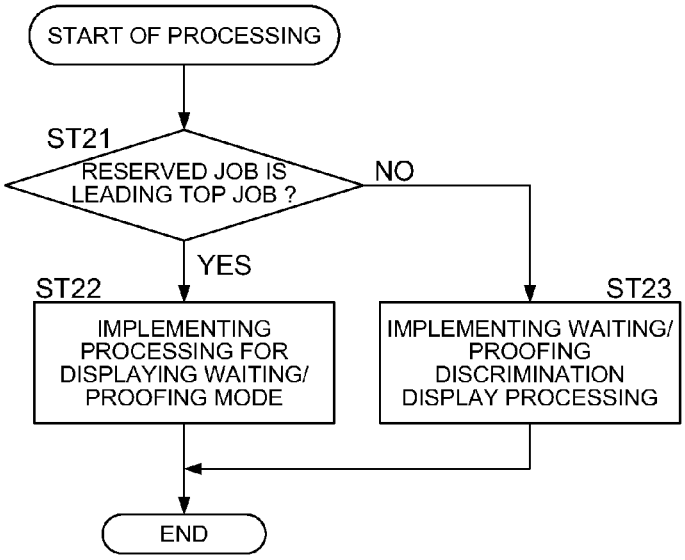
FIG. 16 shows a flowchart indicating a display controlling example to be conducted with respect to a reserved job including a waiting/proofing mode, etc.

Further, according to the display controlling example of the reserved job including the waiting/proofing mode, etc., shown in FIG. 16, in Step ST21, the image controlling CPU 5 determines whether or not the reserved job, including the waiting/proofing mode, etc., is such a job that is written at the leading top line of the job schedule screen G1 or the job list screen G2 (leading top job).

When determining that the reserved job, including the waiting/proofing mode, etc., is positioned at the leading top position (Step ST21; Yes), the image controlling CPU 5 implements the processing for displaying the waiting/proofing mode in Step ST22. At this time, according to the example shown in FIG. 9, since the reserved job corresponding to the job ID="0013" has been changed to the outputting job, the color of characters of the job setting information Ds, including "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=13:47, "USER'S NAME"; <DABC> and "FILE NAME"; <defgabc>, which are currently displayed in red characters on the black background, is changed (updated) to the orange color from the machine stoppage color (red). Further, since the reserved job has been changed to the outputting job, the "STATUS" is also changed to the <operation waiting> from the <outputting enable>. Still further, the "TIME (MINUTES)", shown in FIG. 7, is also changed (rewritten) to the "RESIDUAL TIME DISPLAY"=9 from the "COMMENCEMENT TIME DISPLAY"=13:47. After that, the image controlling CPU 5 finalizes the display controlling operation in regard to the reserved job concerned.

When determining that the reserved job, including the waiting/proofing mode, etc., is not positioned at the leading top position (Step ST21; No), the image controlling CPU 5 shifts the processing to Step ST23, so as to implement the waiting/proofing discrimination display processing. At this time, according to the example shown in FIG. 9, the reserved job corresponding to the job ID="0013" and including the waiting mode is displayed on the job list screen G2 of the LCD monitor 91 as the fourth reserved job.

On the other hand, the reserved jobs, respectively corresponding to the job IDs="0010", "0011", "0012" and "0014", and positioned before and after the concerned reserved job corresponding to the job ID "0013", are displayed by using white characters on the black background. In contrast to them, with respect to the reserved job corresponding to the job ID="0013" and including the waiting mode, the job setting information Ds, including "STATUS"=outputting enable, "NUMBER OF PAPER SHEETS"=20, "NUMBER OF COPIES"=50, "NUMBER OF RESIDUAL PAPER SHEETS"=1000, "TIME (MINUTES)"=13:47, "USER'S NAME"; <ADBC> and "FILE NAME"; <efgabcd>, is displayed by using red characters on the black background.

As described in the foregoing, according to the digital MFP 100 embodied in the present invention, the display operating section 9 is operated so as to accept a plurality of reserved jobs to be implemented by the printer section 24. The image controlling CPU 5 extracts such reserved jobs that include the job continuous implementation impeding factors, such as the waiting mode, the proofing mode, etc., from the reserved jobs accepted by the display operating section 9, so as to establish and attach the red identification mark M indicated by symbol "▼" for indicating the job continuous implementation impeding factor, to each of the extracted reserved jobs. On the above-mentioned premise, the display operating section 9 displays both the reserved job, to which the red identification mark M is attached by the image controlling CPU 5, and the other job, to which the red identification mark M is not attached, on the job schedule screen G1 in the synopsis manner.

Accordingly, it becomes possible for the printer section 24 to sequentially implement the reserved jobs displayed on the job schedule screen G1 in the synopsis manner, one by one corresponding to the presence or absence of the red identification mark M. According to this feature of the present invention, during the continuous outputting operations of a large number of print jobs reserved in advance, it becomes possible for the operator (user) to visually recognize the suitable time when the operator should stay at the machine side concerned, even if the reserved job concerned includes the job continuous implementation impeding factor, such as the waiting mode, the proofing mode, etc., and as a result, it also becomes possible to improve the efficiency of the printing operation in which a large amount of print jobs should be handled.

In this example, since the reserved jobs are displayed on the job list screen G2 in separate colors, during the continuous outputting operations of a large number of print jobs reserved in advance, it becomes possible for the operator (user) to easily recognize the reserved job, including the waiting mode, the proofing mode, etc., among the reserved jobs (waiting/proofing discrimination display processing).

Further, with respect to the reserved job to which the red identification mark M indicated by symbol "▼" is attached, as shown in FIG. 3, since the outputting time information (13:47), representing the time when the reserved job concerned will be commenced, is displayed on the job schedule screen G1 and the job list screen G2, it becomes possible for the concerned operator (user) to visually recognize the suitable time when the operator should stay at the machine side concerned. As a result, it becomes possible to improve the efficiency of the printing operation in regard to the reserved job concerned.

The present invention can be preferably available for a copier, a printer, an MFP (Multi Function Peripheral), etc., which implements a reserved job registered as a image file attached with image forming conditions including the waiting mode, the proofing mode, etc.

According to present invention, following effects can be attained.

(1) The image forming apparatus, embodied in the present invention, is provided with the controlling section to extract a specific reserved job, which includes the job continuous implementation impeding factor, from the plurality of reserved jobs inputted through the operating section, so as to set discrimination information representing the job continuous implementation impeding factor into the specific reserved job, and the displaying section to display the specific reserved job to which the discrimination information is set and other reserved jobs to which the discrimination information is not set, on the same screen in the synopsis manner.

According to the abovementioned configuration, it becomes possible for the image forming section to sequentially implement the reserved jobs displayed on the same screen, corresponding to the presence or absence of the discrimination information. Accordingly, during the continuous outputting operations of a large number of print jobs reserved in advance, it becomes possible for the operator (user) to visually recognize the suitable time when the operator should stay at the machine side concerned, even if the reserved job concerned includes the job continuous implementation impeding factor, such as the waiting mode, the proofing mode, etc., and as a result, it also becomes possible to improve the efficiency of the printing operation in which a large amount of print jobs should be handled.

(2) Since the displaying section displays the reserved job currently in mid-course of implementing, or a plurality of reserved jobs, including the specific reserved job, and each of which is in a standby state for waiting its implementation turn, on a job schedule screen, it becomes possible for the operator (user) to easily recognize the specific reserved job including the waiting mode or the proofing mode among the reserved jobs, during the continuous outputting operations of a large number of print jobs reserved in advance.

(3) Since the displaying section displays the specific reserved job to which the discrimination information is set, in such a manner that the specific reserved job can be discriminated from the other reserved jobs to which the discrimination information is not set, on the job schedule screen in the synopsis manner, it becomes possible for the operator (user) to easily recognize the specific reserved job including the waiting mode or the proofing mode among the reserved jobs, during the continuous outputting operations of a large number of print jobs reserved in advance.

(4) Since the displaying section displays the reserved job currently in mid-course of implementing, or a plurality of reserved jobs, each of which is in a standby state for waiting its implementation turn, on the job list screen in a synopsis manner, it becomes possible for the operator (user) to easily recognize the specific reserved job including the waiting mode or the proofing mode among the reserved jobs, during the continuous outputting operations of a large number of print jobs reserved in advance.

(5) Since the displaying section displays the specific reserved job to which the discrimination information is set and the other reserved jobs to which the discrimination information is not set, on the job list screen in the synopsis manner by employing separate colors being different between the specific reserved job and the other reserved jobs, it becomes possible for the operator (user) to easily recognize the specific reserved job including the waiting mode or the proofing mode among the reserved jobs, during the continuous outputting operations of a large number of print jobs reserved in advance.

(6) Since, with respect to the specific reserved job to which the discrimination information is set, the displaying section displays time information representing the time for commencing the print job on the job list screen, it becomes possible for the operator (user) to visually recognize the suitable time when the operator should stay at the machine side concerned.

(7) Since, when the specific reserved job is ranked at the leading top position on the job list screen, the displaying section displays the specific reserved job in a specific displaying mode being different from a displaying mode to be employed when the specific reserved job is not ranked at the leading top position, it becomes possible for the operator (user) to easily recognize an arrival of the specific reserved job including the waiting mode or the proofing mode among the reserved jobs, during the continuous outputting operations of a large number of print jobs reserved in advance.

(8) Since the job continuous implementation impeding factor includes the waiting mode, it becomes possible to make the implementation of the reserved job wait until the image forming conditions are displayed and the operator conducts the outputting operations, when the specific reserved job including the waiting mode is to be implemented, during the continuous outputting operations of a large number of print jobs reserved in advance.

(9) Since the job continuous implementation impeding factor includes the proofing mode, it becomes possible to disable the printing machine concerned after an operation for printing only a single copy has been completed, irrespective of a number of copies to be printed in respect to the reserved job, when the specific reserved job including the proofing mode is to be implemented, during the continuous outputting operations of a large number of print jobs reserved in advance.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

an image forming section that implements a print job for forming an image onto a transfer sheet based on predetermined image information and established image forming conditions;

a setting section that implements a processing for setting and registering the image forming conditions, including a job continuous implementation impeding factor, into the predetermined image information to establish a reserved job, wherein the job continuous implementation impeding factor serves as a cause of impeding a continuous implementation of plural print jobs when the plural print jobs are to be continuously implemented;

an operating section that accepts operations for inputting a plurality of reserved jobs to be implemented by the image forming section;

a controlling section that extracts a specific reserved job, which includes the job continuous implementation impeding factor that serves as the cause of impeding the continuous implementation of the plural print jobs, from the plurality of reserved jobs inputted through the operating section, so as to set discrimination information representing the job continuous implementation impeding factor into the specific reserved job extracted from the plurality of reserved jobs; and a displaying section that displays the specific reserved job to which the discrimination information is set and other reserved jobs to which the discrimination information is not set, both included in the plurality of reserved jobs, on a same list in a synopsis manner.

2. The image forming apparatus of claim 1, wherein the displaying section displays the reserved job, which is currently in mid-course of implementing, or a plurality of reserved jobs, including the specific reserved job to which the discrimination information is set, and each of which is in a standby state for waiting its implementation turn, on a job schedule screen in which tray information is allotted in a direction of one of axes, while, time information is allotted in a direction of another one of the axes.

3. The image forming apparatus of claim 2, wherein the displaying section displays the specific reserved job to which the discrimination information is set, in such a manner that the specific reserved job can be discriminated from the other reserved jobs to which the discrimination information is not set, on the job schedule screen in the synopsis manner.

4. The image forming apparatus of claim 1, wherein the displaying section displays the reserved job, which is currently in mid-course of implementing, or a plurality of reserved jobs, each of which is in a standby state for waiting its implementation turn, on a job list screen in which the image forming conditions including the job continuous implementation impeding factor and the image information are written, corresponding to ID information for discriminating the reserved jobs with each other, in a synopsis manner.

5. The image forming apparatus of claim 4, wherein the displaying section displays the specific reserved job to which the discrimination information is set and the other reserved jobs to which the discrimination information is not set, both included in the plurality of reserved jobs, on the job list screen in the synopsis manner by employing separate colors being different between the specific reserved job and the other reserved jobs.

6. The image forming apparatus of claim 5, wherein, with respect to the specific reserved job to which the discrimination information is set, the displaying section displays time information representing a time for commencing the print job on the job list screen.

7. The image forming apparatus of claim 6, wherein, when the specific reserved job, to which the discrimination information is set, is ranked at a leading top position on the job list screen, the displaying section displays the specific reserved job in a specific displaying mode being different from a displaying mode to be employed when the specific reserved job is not ranked at the leading top position.

8. The image forming apparatus of claim 1, wherein a functional mode in which implementation of the reserved job is kept waiting, until the image forming conditions are displayed and an operator conducts outputting operations, is defined as a waiting mode; and wherein the job continuous implementation impeding factor includes the waiting mode.

9. The image forming apparatus of claim 1, wherein a functional mode in which, irrespective of a number of copies to be printed in respect to the reserved job, a printing machine is disabled after an operation for printing only a single copy has been completed, is defined as a proofing mode; and wherein the job continuous implementation impeding factor includes the proofing mode.

10. An image forming method, comprising:

implementing a print job for forming an image onto a transfer sheet based on predetermined image information and established image forming conditions;

setting and registering the image forming conditions, including a job continuous implementation impeding factor, into the predetermined image information to establish a reserved job, wherein the job continuous implementation impeding factor serves as a cause of impeding a continuous implementation of plural print jobs when the plural print jobs are to be continuously implemented;

accepting operations for inputting a plurality of reserved jobs to be implemented in the implementing step;

extracting a specific reserved job, which includes the job continuous implementation impeding factor that serves as the cause of impeding the continuous implementation of the plural print jobs, from the plurality of reserved jobs inputted in the accepting step, so as to set discrimination information representing the job continuous implementation impeding factor into the specific reserved job extracted from the plurality of reserved jobs;

displaying the specific reserved job to which the discrimination information is set and other reserved jobs to which the discrimination information is not set, both included in the plurality of reserved jobs, on a same list in a synopsis manner.

11. The image forming method of claim 10, wherein the reserved job, which is currently in mid-course of implementing, or a plurality of reserved jobs, including the specific reserved job to which the discrimination information is set, and each of which is in a standby state for waiting its implementation turn, is displayed on a job schedule screen in which tray information is allotted in a direction of one of axes, while, time information is allotted in a direction of another one of the axes.

12. The image forming method of claim 11, wherein the specific reserved job, to which the discrimination information is set, is displayed in such a manner that the specific reserved job can be discriminated from the other reserved jobs to which the discrimination information is not set, on the job schedule screen in the synopsis manner.

13. The image forming method of claim 10, wherein the reserved job, which is currently in mid-course of implementing, or a plurality of reserved jobs, each of which is in a standby state for waiting its implementation turn, is displayed on a job list screen in which the image forming conditions including the job continuous implementation impeding factor and the image information are written, corresponding to ID information for discriminating the reserved jobs with each other, in a synopsis manner.

14. The image forming method of claim 13, wherein the specific reserved job to which the discrimination information is set and the other reserved jobs to which the discrimination information is not set, both included in the plurality of reserved jobs, are displayed on the job list screen in the synopsis manner by employing separate colors being different between the specific reserved job and the other reserved jobs.

15. The image forming method of claim 14, wherein, with respect to the specific reserved job to which the discrimination information is set, time information representing a time for commencing the print job is displayed on the job list screen.

16. The image forming method of claim 15, wherein, when the specific reserved job, to which the discrimination information is set, is ranked at a leading top position on the job list screen, the specific reserved job is displayed in a specific displaying mode being different from a displaying mode to be employed when the specific reserved job is not ranked at the leading top position.

17. The image forming method of claim 10, wherein a functional mode in which implementation of the reserved job is kept waiting, until the image forming conditions are displayed and an operator conducts outputting operations, is defined as a waiting mode; and wherein the job continuous implementation impeding factor includes the waiting mode.

18. The image forming method of claim 10, wherein a functional mode in which, irrespective of a number of copies to be printed in respect to the reserved job, a printing machine is disabled after an operation for printing only a single copy has been completed, is defined as a proofing mode; and wherein the job continuous implementation impeding factor includes the proofing mode.

* * * * *